US007410379B1

(12) United States Patent
Byrne

(10) Patent No.: US 7,410,379 B1
(45) Date of Patent: Aug. 12, 2008

(54) MULTIPLE CIRCUIT RECEPTACLES

(76) Inventor: Norman R. Byrne, 2736 Honey Creek NE., Ada, MI (US) 49301

( * ) Notice: Subject to any disclaimer, the term of this patent is extended or adjusted under 35 U.S.C. 154(b) by 487 days.

(21) Appl. No.: 10/550,767

(22) PCT Filed: Apr. 27, 2005

(86) PCT No.: PCT/US2005/014495

§ 371 (c)(1),
(2), (4) Date: Sep. 27, 2005

(87) PCT Pub. No.: WO2006/115495

PCT Pub. Date: Nov. 2, 2006

(51) Int. Cl.
*H01R 25/16* (2006.01)

(52) U.S. Cl. ..... 439/215; 439/53; 439/218

(58) Field of Classification Search ..... 439/215, 439/53, 218, 211, 43
See application file for complete search history.

(56) References Cited

U.S. PATENT DOCUMENTS 4,367,370 A * 1/1983 Wilson et al. ..... 174/495
4,666,223 A * 5/1987 Tillmann ..... 439/221
4,775,328 A * 10/1988 McCarthy ..... 439/211
4,781,609 A * 11/1988 Wilson et al. ..... 439/215
5,087,207 A * 2/1992 Byrne ..... 439/215
5,096,431 A * 3/1992 Byrne ..... 439/171
6,491,535 B1 * 12/2002 Buse ..... 439/215

* cited by examiner

*Primary Examiner*—Gary F. Paumen
(74) *Attorney, Agent, or Firm*—Varnum, Riddering, Schmidt & Howlett LLP

(57) ABSTRACT

A multiple circuit receptacle system (100) is disclosed. The receptacle system (100) includes a junction block (102) having an incoming female connector set (122) adapted to be engaged with a cable assembly (180) for supplying incoming power to the junction block (102). He junction block (102) also has a further female connector set (154), electrically coupled to the incoming female connector set (122), through which power is supplied from the cable assembly (180). The incoming power is in the form of four separate circuits, each circuit having hot, neutral and ground terminals. An electrical outlet receptacle block (160) includes a series of outlet receptacles (159) and connector sets (179, 181) selectively connectable to the further connector set (154) of the junction block (102). Connection of the receptacle block (160) to the junction block (102) in one of various spacial orientations provides for electrical power from any selected one of the multiple circuits to be presented at the outlet receptacles (159).

22 Claims, 13 Drawing Sheets

MULTIPLE CIRCUIT RECEPTACLES

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to electrical power systems and, more particularly, to arrangements for electrically interconnecting outlet receptacle blocks so as to provide for a selected one of a plurality of power supply circuits.

2. Background Art

The use of computers, associated computer peripherals (e.g. printers and the like), copiers, facsimile machines, sophisticated telecommunications equipment and other electronic devices is continuing to rapidly increase in commercial, industrial and office environments. As a result, the importance of efficiently supplying power throughout these environments is also increasing. For example, the use of modular office systems, with multiple workstations and interior walls, has led to electrical systems relatively more sophisticated than conventional designs comprising receptacle mounts and electrical receptacles in stationary walls, with the receptacles energized from incoming power supplies extending through wall interiors. Such conventional and stationary wall-mounted systems were often located a substantial distance from the electrical devices to be energized and numerous electrical cords connecting the devices to the outlets would cause unsightly and sometimes dangerous entanglements. Thereafter, movable pluggable units having a number of receptacles on a common power source cord to be plugged into the conventional utility outlets were used. Again, however, such units resulted in unsightly and entangled arrays of electrical device cords.

With the growth of the use of electrical power in office systems, it became known to employ removable wall panels or the like, which defined modular workplace areas. Further, raceway areas were developed for use in the panels or other structures, for accommodating electrical wiring and electrical junction blocks near the locations to be energized. Typically, junction blocks were mounted within the raceway areas by attaching them with various types of structural arrangements. Outlet receptacle blocks having a number of receptacles were first formed as an integral part of the junction blocks. Thereafter, it became known to employ receptacles which were assembled as devices separate from the junction blocks, but were mechanically and electrically connectable to the junction blocks. During the past two decades, a substantial amount of research and development have been directed to raceways, junction blocks and receptacles, means for interconnection of the junction blocks and receptacles, and mounting of the junction blocks within the raceways.

One aspect of the increasing use of electrical power relates to circuit loads. Any particular electrical circuit is limited to carrying a finite power load. Previously, when electrical power was not used to the extent that it is today, a single electrical circuit interconnecting to an incoming power supply was typically sufficient to handle power requirements. Accordingly, wiring within stationary or movable walls could comprise only two (hot and neutral) or three (hot, neutral and ground) wires, with receptacle blocks having single (simplex) or double (duplex) receptacles typically wired directly to the incoming two or three wire circuit. However, today, it is advantageous to employ systems having an incoming power supply comprising multiple electrical circuits.

Further, however, having the availability of multiple circuits has led to other electrical wiring issues. For example, a number of junction blocks and outlet receptacle blocks may be assembled within several raceways of a modular system, with wiring and bus bars configured for interconnection of the outlet receptacles to a particular one of the available multiple circuits. However, over time, electrical power loads may change, resulting in load balance problems and the like. These changes may require circuit reconfigurations involving substantial rewiring and "changeout" of junction blocks, receptacles and other electrical components to other devices having different wire and bus bar configurations to accommodate circuit changeovers.

Various circuit arrangements have been utilized in the recent past in an attempt to provide circuit selection. For example, McCarthy, U.S. Pat. No. 4,775,328, issued Oct. 4, 1988, discloses an electrical power assembly for installation in a raceway of a wall panel, of a type commonly used in modular wall systems for constructing office and other work areas. The McCarthy configuration includes a power block having seven wires, representing three separate circuits, and several ports for receiving different outlet receptacle adapters or modules. Different modules are utilized to connect a power cord or the like to the different circuits of the power block. Each of the ports of the power block has seven terminals, corresponding to the seven wires, and each of several outlet receptacle modules has a uniquely positioned set of three terminals for engaging a predetermined set of three of the seven power block terminals. In this manner, different outlet receptacle modules provide electrical connections to different ones of the three separate circuits. A disadvantage of this prior art arrangement is that a separate supply of receptacle modules must be kept, and a receptacle module of proper type must be found each time a change is to be made to a different circuit arrangement. This presents a substantial inconvenience to the user and requires a separate stocking of these parts.

Byrne, U.S. Pat. No. 5,087,207, issued Feb. 11, 1992, presented a substantial advance with respect to circuit selection. The Byrne arrangement utilized a pair of adapter blocks, each arrangeable in two physical orientations. These blocks provided an interface between an electrical outlet receptacle block and four different electrical circuits of a power distribution block. Each of the adapter blocks included terminals on one end for engaging the receptacle block, including one terminal disposed on the centerline of the adapter and a pair of terminals disposed on opposing sides and equidistant from the centerline. Further, each adapter block included terminals on an opposite end for engagement with the power distribution block. The adapter block also included terminals disposed on opposite sides of the centerline and offset from the centerline by different distances. Each adapter block could be changed from one physical orientation to another by rotation about the centerline. One of the blocks, in a first physical orientation, connected a first positive terminal, a first neutral terminal and a ground terminal of the power distribution block to the outlet receptacle block. In a second orientation, connection was made to a second one of the positive terminals, a second one of the neutral terminals and a ground terminal of the power distribution block to the outlet receptacle block. Correspondingly, the second adapter block, in a first physical orientation, connected a third positive terminal, a third neutral terminal and a ground terminal of the power distribution block to the outlet receptacle block. In a second physical orientation, the second adapter block connected a fourth positive terminal, a fourth neutral terminal and a ground terminal of the power distribution block to the outlet receptacle block.

Wilson et al, U.S. Pat. No. 4,367,370, issued Jan. 4, 1983, discloses an outlet receptacle block having a ground terminal, a common terminal and three positive terminals for engaging corresponding terminals of a junction block. The ground and common terminals are connected to the ground and common receptacle output terminals for engagement with the prongs of a standard three-prong electrical cord. The receptacle block further includes a switch which selectively connects one of the three positive prongs to the positive receptacle outlet connector, internal to the outlet receptacle block.

In another prior art arrangement in Tillmann, U.S. Pat. No. 4,666,223, issued May 19, 1987, an outlet receptacle block is provided with a movable terminal to selectively engage one of three positive junction block terminals. The outlet receptacle block of this prior art arrangement includes a conducting shaft electrically connected to the positive outlet terminal of the outlet receptacle block and to the movable terminal. The movable terminal may be slid upwardly or downwardly to a desired position for engagement with one of three positive connector terminals of the junction block.

In yet another prior art arrangement in Wilson et al, U.S. Pat. No. 4,781,609, issued Nov. 1, 1998, an outlet receptacle block is provided with a pair of slideable terminals mounted on a carrier so as to provide for synchronous movement of two contacts. A junction block is provided with a ground terminal, three positive terminals and three common terminals, thereby defining three separate circuits with a common ground. The carrier on the outlet receptacle block may be positioned so that one of its terminals engages one of the positive terminals of the junction block, while the other engages the corresponding common terminal. A sliding electrical contact internal to the receptacle block provides contact between the moveable terminals and corresponding terminals for engagement with the prongs of a standard electrical cord.

With several of the above-mentioned prior art arrangements, an electrical switch contact between a moveable part and a stationary part is employed to connect the outlet terminals of the outlet receptacle block.

Byrne, U.S. Pat. No. 5,096,431, issued Mar. 17, 1992, provided another substantial advance with an outlet receptacle block having rearrangeable terminals. In Byrne, an electrical outlet receptacle block comprises a housing and at least one flexible bus bar having one portion fixedly attached to the housing and electrically connected to one of the outlet receptacle terminals of the receptacle block. An end of the flexible bus bar is a moveable terminal end, which may be moved to at least two separate positions for selective alignment with different terminals of a junction block having at least two different circuits.

Byrne discloses one embodiment with an electrical junction block comprising eight terminals, with four positive terminals, two neutral terminals and two ground terminals. The outlet receptacle block is provided with three bus bars for connection to positive, neutral, and ground outlet terminals. The flexible bus bars may be selectively positioned to connect the ground outlet terminal to either of the two ground junction block terminals. In addition, the neutral outlet terminal can be connected to either of the two neutral junction block terminals, and the positive outlet terminal can be connect to any one of the four positive junction block terminals.

The outlet receptacle block can be provided with at least one manually operable control lever engaging the moveable end of at least one flexible bus bar. The housing of the receptacle outlet block is provided with an elongated slot on one surface for accommodating the control lever. The control lever can be disposed partially below the surface, with a protuberance extending through the slot. The protuberance is of a generally rectangular shape and fits snugly in the opening to prevent any significant rotation. The control lever, of which the protuberance is a part, is provided with an opening which engages a longitudinal section of a conductor bar. Movement of the control lever in the slot causes a bending in a portion of the control bar between the control lever and a fixed anchor point of the flexible bus bar internal to the receptacle outlet block housing. A terminal end portion of the bus bar extends beyond the control lever substantially perpendicular to an end wall of the receptacle block housing. This is provided for engagement with terminals of the junction block.

SUMMARY OF THE INVENTION

In accordance with the invention, a multiple circuit receptacle system includes power supply means for supplying electrical power to the receptacle system. The power supply means supplies the electrical power in the form of a plurality of power supply circuits. An outlet receptacle block includes receptacle means adapted to be electrically interconnected to selectively interconnected electrical devices. The outlet receptacle block has circuit means for electrically and selectively coupling the receptacle means to the power supply means in a plurality of spacial orientations. In this manner, any one of the plurality of the power supply circuits is electrically coupled to the receptacle means.

The receptacle circuit means can comprise a plurality of electrical receptacle connector sets, with each of the connector sets adapted to be electrically and selectively coupled to the power supply means. The particular one of the power supply circuits to which the receptacle means is coupled at any given time is dependent, at least in part, on which of the receptacle connector sets is electrically coupled to the power supply means. The plurality of receptacle connector sets can comprise a first receptacle connector set and a second receptacle connector set. The first receptacle connector set is capable of being electrically coupled to the power supply means in a first spatial orientation, thereby electrically coupling a first one of the power supply circuits to the receptacle means. The first receptacle connector set is also capable of being electrically coupled to the power supply means in a second spatial orientation, thereby electrically coupling a second one of the power supply circuits to the receptacle means.

Still further, the second receptacle connector set is capable of being electrically coupled to the power supply means in a third spatial orientation, thereby electrically coupling a third one of the power supply circuits to the receptacle means. Also, the second receptacle connector set is further capable of being electrically coupled to the power supply means in a fourth spatial orientation. In this fourth spatial orientation, a fourth one of the power supply circuits is electrically coupled to the receptacle means.

The outlet receptacle block comprises a first side and a second side. The second side faces in an opposing direction to the first side. The receptacle means comprises at least a first outlet receptacle on the first side of the receptacle block, and at least a second outlet receptacle on the second side of the outlet receptacle block. The circuit means can comprise a first receptacle connector set extending outwardly on a first end of the outlet receptacle block. A second receptacle connector set extends outwardly on a second end of the outlet receptacle block. The power supply means can comprise junction block means, with the junction block means comprising an incoming power supply connector means for receiving incoming electrical power. Outgoing junction block connector means are electrically coupled to the incoming power supply connector means, and are connectable to the receptacle circuit means for supplying the incoming power to the receptacle means.

The receptacle circuit means includes a first receptacle connector set and a second receptacle connector set. The outgoing junction block connector means comprises a first outgoing junction block connector set. Connecting the first receptacle connector set to the outgoing junction block connector set, with the first receptacle connector set being in a first spatial orientation relative to the first outgoing junction block connector set, results in the receptacle means being electrically coupled to a first one of the plurality of power supply circuits. Connecting the first receptacle connector set to the first outgoing junction block connector set, with the first receptacle connector set being in a second spatial orientation, results in the receptacle means being electrically coupled to a second one of the power supply circuits. Connecting the second receptacle connector set to the first outgoing junction block connector set, with the outlet receptacle block being in a third spatial orientation relative to the first outgoing junction block connector set, results in the receptacle means being electrically coupled to a third one of the plurality of power supply circuits. Correspondingly, connecting the second receptacle connector set to the first outgoing junction block connector set, with the outlet receptacle block being in a fourth spatial orientation relative to the first outgoing junction block connector set, results in the receptacle means being electrically coupled to a fourth one of the plurality of power supply circuits.

The outgoing junction block connector means can comprise a first outgoing junction block connector set located on a first side of the junction block, and a second outgoing junction block connector set located on a second side of the junction block, with the second side opposing the first side. The receptacle circuit means is configured so as to be capable of electrically coupling to either the first outgoing junction block connector set or the second outgoing junction block connector set.

The first receptacle connector set of the receptacle circuit means can be associated with a first end of the outlet receptacle block, and the second receptacle connector set can be associated with a second end of the outlet receptacle block, with the second receptacle end being opposed to the first receptacle end. The first receptacle connector set can have a plurality of terminals positioned so as to form a first configuration. The second receptacle connector set can have a plurality of terminals positioned so as to form a second configuration. The outlet receptacle block can have a top portion and a bottom portion, with the bottom portion opposing the top portion. The power supply means includes a junction block with the first junction block connector set electrically coupled to the plurality of power supply circuits. Connection of the plurality of terminals of the first receptacle connector set to the first junction block connector set, with the outlet receptacle block being in a first spatial orientation, results in the receptacle means being electrically coupled to a first one of the plurality of power supply circuits.

Connection of the plurality of terminals of the second receptacle connector set to the first junction block connector set, with the outlet receptacle block being in a second spatial orientation relative to the junction block, results in the receptacle means being electrically coupled to a second one of the power supply circuits when, in moving the outlet receptacle block from the first spatial orientation to the second spatial orientation, the outlet receptacle block is flipped end-to-end relative to the junction block connector set.

Connection of the plurality of terminals of the first receptacle connector set to the junction block connector set, with the outlet receptacle block being in a third spatial orientation, results in the receptacle means being electrically coupled to a third one of the power supply circuits when, in moving the outlet receptacle block from the second spatial orientation to the third spatial orientation, the outlet receptacle block is flipped so as to reverse the positions of its top portion and its bottom portion, relative to the first junction block connector set. Connection of the plurality of terminals of the second receptacle connector set to the first junction block connector set, with the outlet receptacle block being in a fourth spatial orientation relative to said junction block, results in the receptacle means being electrically coupled to a fourth one of the plurality of power supply circuits when, in moving the outlet receptacle block from the third spatial orientation to the fourth spatial orientation, the outlet receptacle block is flipped end-to-end relative to the first junction block connector set.

The first junction block connector set can be associated with a first side of the junction block, and the junction block can comprise a second junction block connector set electrically coupled to the plurality of power supply circuits, with the second junction block connector set being associated with a second side of the junction block. The second side of the junction block can oppose the first side of the junction block. Connection of the plurality of terminals of the first receptacle connector set to the second junction block connector set, with the outlet receptacle block being in a fifth spatial orientation relative to the junction block, results in the first outlet receptacle block being electrically coupled to the first one of the plurality of power supply circuits. Connection of the plurality of terminals of the second receptacle connector set to the second junction block connector set, with the outlet receptacle block being in a sixth spatial orientation relative to the junction block, results in the outlet receptacle means being electrically coupled to the second one of the plurality of power supply circuits when, in moving the outlet receptacle block from the fifth to the sixth spatial orientation, the outlet receptacle block is flipped end-to-end relative to the second junction block connector set.

Connection of the plurality of terminals of the first receptacle connector set to the second junction block connector set, with the outlet receptacle block being in a seventh spatial orientation relative to the junction block, results in the receptacle means being electrically coupled to the third one of the plurality of power supply circuits when, in moving the outlet receptacle block from the sixth to the seventh spatial orientation, the outlet receptacle block is flipped so as to reverse the positions of its top portion and its bottom portion, relative to the second junction block connector set. Connection of the plurality of terminals of the second receptacle connection set to the second junction block connector set, with the outlet receptacle block being in an eighth spatial orientation relative to said junction block, results in the receptacle means being electrically coupled to the fourth one of the plurality of power supply circuits when, in moving the outlet receptacle block from the seventh spatial orientation to the eighth spatial orientation, the outlet receptacle block is flipped end-to-end relative to the second junction block connector set.

The outlet receptacle block can include latch means. The power supply means can comprise at least one junction block having tab means. The latch means and the tab means can cooperate so as to prevent the receptacle circuit means from inadvertently releasing from the junction block in the absence of any externally exerted forces on the outlet receptacle block, when the receptacle means is electrically coupled to the junction block. The latch means can include locking latches positioned on top and bottom portions of the outlet receptacle block, with each of the locking latches being of a resilient construction. The tab means can comprise an upstanding tab, so that when the outlet receptacle block is first brought into position to be electrically coupled to the junction block, the tab exerts upwardly directed forces on at least one of the locking latches, thereby causing said at least one locking latch to resiliently deflect upward. The tab and at least one locking latch are sized and configured so that when the tab is causes the locking latch to resiliently deflect upwardly, manual forces can be exerted sideways on the outlet receptacle block, so as to move the receptacle circuit means to an electrical coupling with the power supply means. When the power supply means is electrically coupled to the receptacle circuit means, the at least one locking latch is positioned to the side of the tab in a non-deflected state. Further, when the at least one locking latch is positioned to the side of the tab, the receptacle circuit means are prevented from becoming decoupled from the power supply means, in the absence of external forces being directed upwardly on the locking latch, so as to resiliently deflect the at least one locking latch upwardly.

The plurality of power supply circuits can each comprise at least one hot conductor, with at least two of the hot conductors of two of the plurality of power supply circuits being physically separated by at least one of either a ground conductor or a neutral conductor. The power supply means can supply electrical power in the form of an 8-wire supply, with the 8-wire supply comprising four hot conductors, two neutral conductors and two ground conductors. Each of the hot conductors can be physically separated by at least one of either of the neutral conductors of the ground conductors.

The junction block can include incoming connector means for electrically coupling the plurality of power supply circuits to the junction block. The junction block can also comprise means for transmitting the incoming power to a first outgoing connector set. An outlet receptacle block can have a plurality of receptacles adapted to selectively interconnect to electrical devices. The outlet receptacle block can include a first receptacle connector set, with a plurality of first terminals therein. The first terminals can be adapted to be electrically and selectively coupled to the first outgoing connector set in a plurality of spatial orientations, with each of the spatial orientations causing a different one of the plurality of power supply circuits to be electrically coupled to the plurality of outlet receptacles. The outlet receptacle block can also include a second connector set having a second set of terminals therein. The second set of terminals can be adapted to electrically and selectively couple the outlet receptacle block to the first outgoing connector set in a plurality of spatial orientations, with each of the spatial orientations causing a different one of the plurality of power supply circuits to be electrically coupled to a plurality of outlet receptacles. The junction block can also include a second outgoing connector set adapted to be selectively and electrically coupled to the first terminals and the second terminals of the outlet receptacle block. The second outgoing connector set can be located on a side of the junction block opposing the side of the junction block on which the first outgoing connector set is located. The outlet receptacle block can include a plurality of bus bars electrically connecting the first and second terminals to the outlet receptacles. In accordance with another aspect of the invention, a system can be provided for supplying electrical power to a receptacle system. The system can include a source of incoming electrical power. A junction block can be electrically connected to the source of incoming electrical power. An outlet receptacle block is adapted to be selectively and electrically coupled to the source of incoming electrical power through the junction block. The outlet receptacle block can include a plurality of outlet receptacles. At least one of the outlet receptacles is located on each of two opposing sides of the outlet receptacle block.

DETAILED DESCRIPTION

Figure 1:
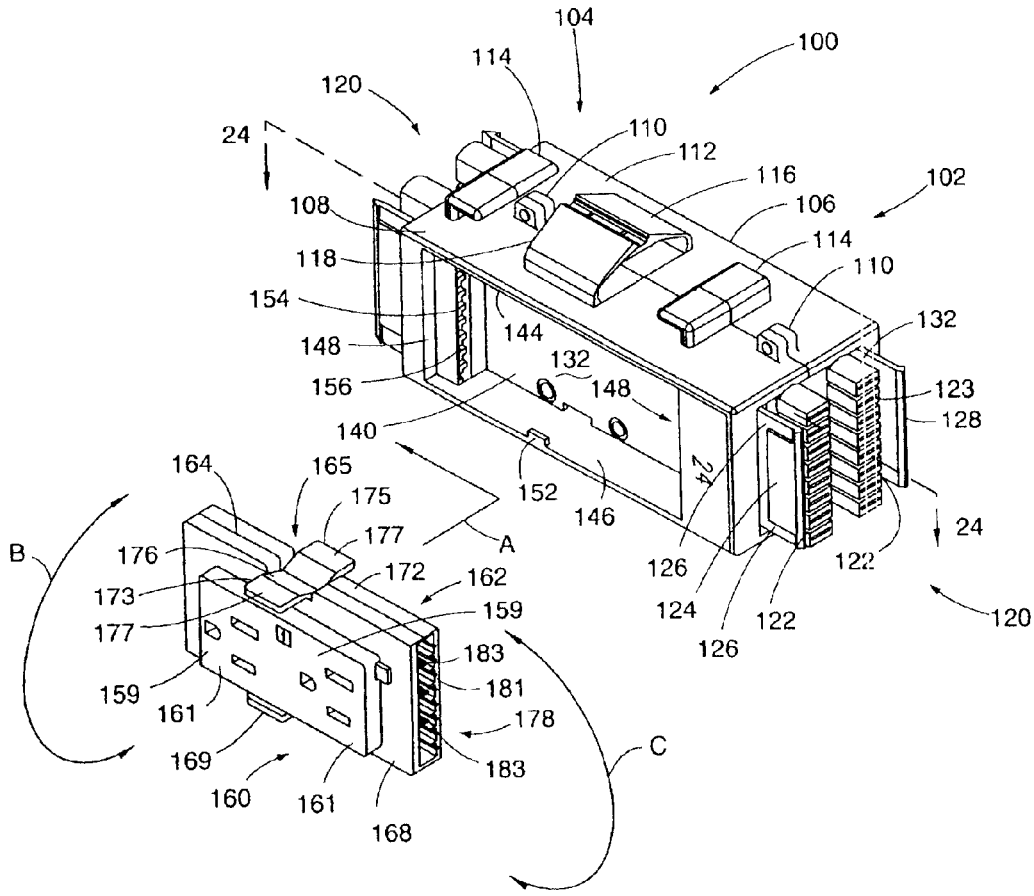
FIG. 1 is a perspective and partially exploded view illustrating an electrical junction block having a plurality of terminals representing a plurality of different electrical circuits, and an electrical outlet receptacle block which can be selectively and electrically interconnected to different ones of the electrical circuits in accordance with the invention.

The principles of the invention are disclosed, by way of example, in a multiple circuit receptacle system 100 as described in subsequent paragraphs herein and illustrated in FIGS. 1-25. The multiple circuit receptacle system 100, in accordance with the invention, provides for the presentation, at outlet receptacles of an outlet receptacle block, of a selected one of a plurality of power supply circuits, and changing to a different selected one of the plurality of power supply circuits, without requiring the use of any tools, multiple receptacle blocks, multiple junction blocks, any changes in structure or physical orientation of junction blocks, or any additional elements, such as circuit adapters or the like. Instead, circuit selection is achieved by reconfiguring the physical orientation of the outlet receptacle block, relative to its interconnection to a power supply junction block. In the particular embodiment disclosed herein, an 8-wire system is described, with the capability of selecting any one of four power supply circuits.

More specifically, and particularly with reference to FIGS. 1-15, the multiple circuit receptacle system 100 comprises a junction block 102 having a housing 104. The housing 104 may have a substantially symmetrical structure and be manufactured and assembled as two opposing and substantially identical halves 106 and 108. The halves can be assembled and interconnected together through various connecting means such as screws or the like (not shown) secured through lugs 110 mounted or otherwise integrally formed on the upper surface of a top portion 112 of the housing 104.

The junction block 102 is relatively conventional in design and, as an example, can be adapted to be secured at its upper portion to a raceway (not shown) or similar structure for housing electrical components in modular office systems and the like. More specifically, the means for mounting the junction block 102 to a raceway can include the use of mounting brackets 114 having L-shaped configurations as illustrated in FIG. 1, and positioned on or otherwise integral with the top portion 112 of the housing 104. The means for mounting the junction block 102 can also include latch members 116, 118 also mounted to or otherwise integral with the top portion 112 of the housing 104. The mounting brackets 114 can engage corresponding support brackets (not shown) attached to a structural member of the raceway (not shown). Correspondingly, the latch members 116, 118 can be made to engage a retaining tab (not shown) or the like of the raceway. The use of these types of mounting assemblies and their attachment to structural members of raceways are disclosed in Byrne, U.S. Pat. No. 5,259,787 issued Nov. 9, 1993 and Byrne, U.S. Pat. No. 4,993,576 issued Feb. 19, 1991.

Figure 2:
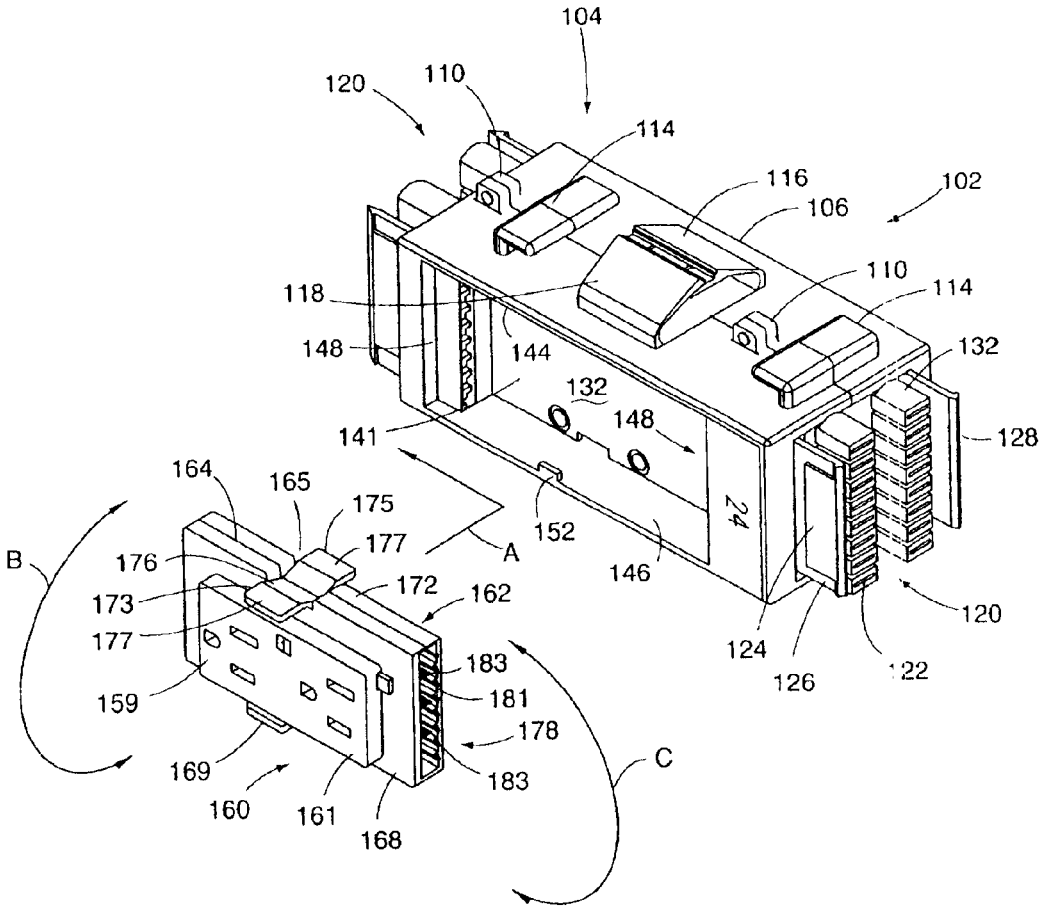
FIG. 2 is a perspective and partially exploded view similar to FIG. 1, but illustrating the opposing side of the junction block, and with a second plurality of terminals representing the plurality of different electrical circuits referred to with respect to FIG. 1.

Referring again to FIGS. 1-15, the junction block 102 includes female connector block pairs 120 extending outwardly from opposing ends of the junction block 102. FIG. 1 illustrates one of the female connector block pairs 120. The junction block 102 is symmetrical in nature, and FIG. 2 illustrates the other of the female connector block pairs 120. The female connector block pairs 120 are similar and symmetrical in nature. Each of the female connector block pairs 120 comprises a pair of female connector sets 122.

Each of the female connector sets 122 is adapted to be releasably engaged with cable assemblies or similar electrical means for supplying incoming power to the junction block 102 or, alternatively, routing power from or through junction block 102 to other junction blocks (not shown) or other electrical devices. Such a cable assembly may, for example, comprise a cable assembly 180 illustrated in part in FIG. 11. The cable assembly 180 includes a cable or conduit section 182.

Figure 11:
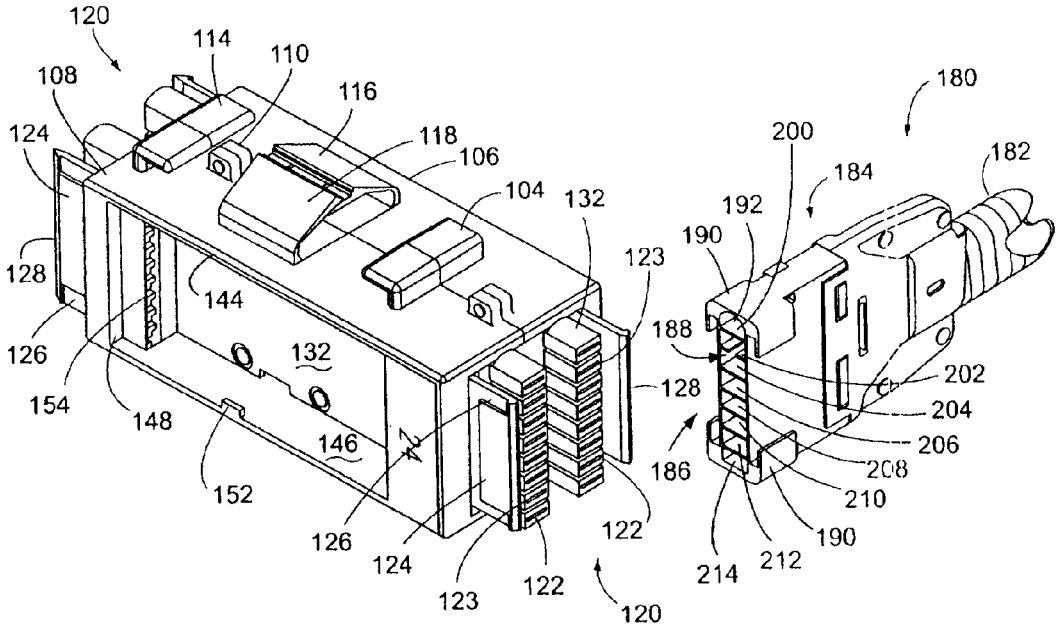
FIG. 11 is a perspective view of the electrical junction block illustrated in FIG. 1, with a cable assembly which may be electrically interconnected to the junction block.
Figure 12:
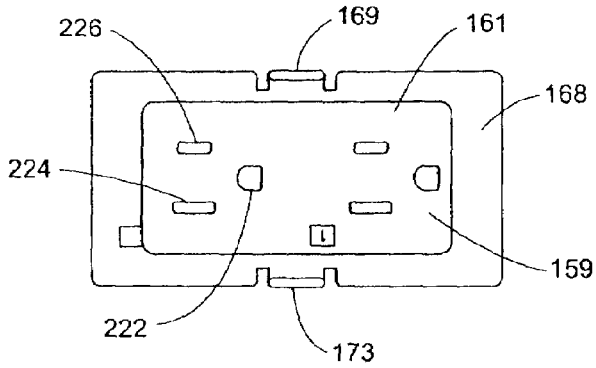
FIG. 12 is an elevation view of one side of the outlet receptacle block illustrated in FIG. 1.

The cable or conduit section 182 is mechanically and electrically connected to a male connector block 184. The male connector block 184 includes, at its terminating end, a male connector set 186 comprises a plurality of male connector terminals 188. In FIG. 11, the male connector terminals 188 are not actually expressly shown, but instead are located within the individual compartments of the male connector set 186. The male connector block 184 and cable or conduit section 182 is adapted to be interconnected to appropriate energy sources so as to provide electrical power to electrical receptacle blocks (subsequently described herein) through the junction block 102. For example, the cable assembly 180 may be directly interconnected to an incoming power feed cable (not shown) or the like. Also, with the use of a plurality of junction blocks 102, cable assembly 180 may be utilized to electrically interconnect junction block 102 with other junction blocks or, alternatively, to other electrical apparatus. For example, the cable assembly 180 may be interconnected to extension cables or similar means for electrical interconnections to other devices over relatively long distances. Returning to the end comprising the male connector set 186, the male connector terminals 188 of the connector set 186 are adapted to mechanically and electrically engage with any one of the female connector sets 122. As illustrated in several of the drawings, including FIGS. 1 and 11, the female connector sets 122 include corresponding female connector terminals 123.

More specifically, each of the female connector sets 122 of one of the female connector block pairs 120 is provided with a side flange 124 having upper and lower recessed areas 126. The upper and lower recessed areas 126 are adapted to assist in providing engagement with flanges 190 of the male connector block 184 associated with the cable assembly 180. In this manner, a releasable locking engagement can be provided between a female connector set 122 and the male connector set 186. The side flanges 124 are preferably made of a resilient plastic material and formed integral with the housing of the junction block 102. Preferably the side flanges 124 are also provided with an outwardly extending inclined end surface 128. When the surfaces 128 are engaged by flanges, such as the flanges 190 of the male connector block 184, the side flanges 124 will be deflected inwardly, allowing the flanges 190 of the male connector block 184 to engage the upper and lower recessed areas 126, so as to provide a releasable locking engagement of the male connector set 186 and the female connector set 122. For purposes of releasing a cable assembly 180 mechanically and electrically interconnected to a junction block 102 through the female connector set 122 and male connector set 186, pressure may be exerted inwardly on the corresponding side flange 124, the flanges 190 of the male connector block 184 will then be released from the recesses 126, and the male connector set 186 can then be retracted from the female connector set 122. In addition to the foregoing, a "keying" arrangement may be utilized for interconnecting the cable assembly 180 to the junction block 102. In this regard, each of the female connector sets 122 may be provided with a key lug 132 at the top portion thereof, as illustrated in FIGS. 1 and 11. Correspondingly, the male connector set 186 may be provided with a key opening 192 for receiving the key lug 132.

The remaining elements of the junction block 102 will now be described primarily with respect to FIGS. 1, 2 and 3. With reference thereto, the housing 104 of the junction block 102 includes a pair of spatial areas 140, 141 which are formed on opposing sides of the junction block 102. In FIGS. 1 and 2, only one of each of the spatial areas 140, 141 is shown. Each of the spatial areas 140, 141 is formed through an interior back wall 132, upper wall 144, lower wall 146 and a pair of opposing end walls 148. Extending upwardly from the lower wall 146 along a front edge thereof is an upwardly projecting locking tab 152. The spatial areas 140, 141 are utilized to accommodate electrical outlet receptacle blocks, such as the receptacle block 160 illustrated in FIGS. 1, 2, 3, 4 and 12-15, and described in greater detail in subsequent paragraphs herein. The locking tab 152 is utilized to releasably secure the receptacle block 160 in a position electrically connected to the junction block 102, as also described in subsequent paragraphs herein.

For purposes of energizing the electrical outlet receptacles blocks 160, the junction block 102 includes, within each spatial area 140, a female receptacle connector set 154, as primarily illustrated in FIGS. 1, 2, 3 and 11. Because FIG. 1 illustrates only one of the spatial areas 140, 141, only one of the female receptacle connector sets 154 is illustrated in FIG. 1. With reference to FIGS. 1 and 2, the female connector set 154 associated with each spatial area 140, 141 is located on what may be characterized as a "left-side" of one of the end walls 148, as the spatial area 140 or 141 is viewed looking directly toward the spatial area 140 or 141, with the junction block 102 having an orientation so that the latch members 116, 118 are at the top. The female receptacle connector set 154 in each recess 140 of the junction block 102 includes a series of female connector terminals 156 having a vertically disposed alignment as illustrated in FIGS. 1, 2, 3 and 11.

Figure 13:
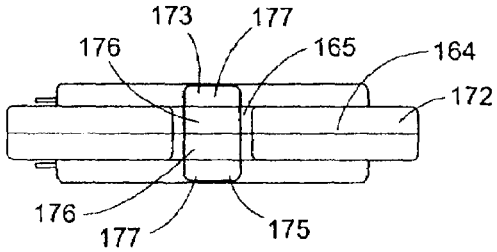
FIG. 13 is a plan view of the electrical outlet receptacle block illustrated in FIG. 1.
Figure 14:
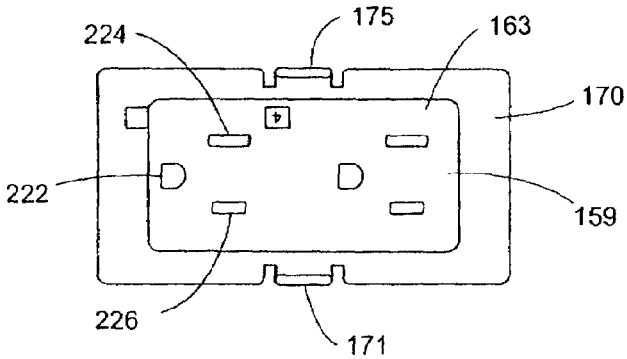
FIG. 14 is an elevation view of the electrical receptacle block shown in FIG. 1, showing the opposing side of the side of the electrical receptacle block illustrated in FIG. 12.

The electrical outlet receptacle block 160 will now be described with respect to FIGS. 1, 2, 3, 4 and 12-15. Referring thereto, the outlet receptacle block 160 includes a housing 162. The housing 162 comprises two symmetrical halves interconnected together along the seam 164 illustrated in FIG. 1 and the seam 166 illustrated in FIG. 4. Any suitable and well known means may be utilized for rigidly securing together the halves of the housing 162. One of the halves of the housing 162 includes a first facial wall or surface 168 (illustrated in FIGS. 1, 2, 3 and 14). The other opposing half of the housing 162 includes a corresponding second facial wall or surface 170. The second facial wall or surface 170 is illustrated in FIG. 14. Further, the two halves of the housing 162 together form an upper wall 172 (illustrated in FIGS. 1, 2 and 13), and a corresponding lower wall 174 (illustrated in FIGS. 4 and 15). Although the description of the electrical outlet receptacle block 160 is referring to "upper" and "lower" walls 172, 174, respectively, it should be emphasized that with the use of the outlet receptacle block 160 in accordance with invention, the receptacle block 160 will be electrically interconnected to the junction block 102 in four different physical orientations. Accordingly, references to "upper" and "lower" portions of the receptacle block 160 should not be taken to mean that any such portions or elements are always in such orientations.

Figure 15:
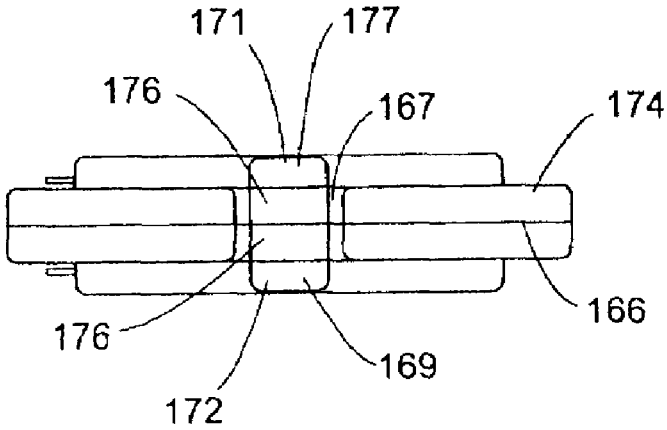
FIG. 15 is an underside view of the electrical receptacle block shown in FIG. 1.

The outlet receptacle block 160 further comprises a pair of opposing receptacle faces, namely a first receptacle face 161 (illustrated in FIGS. 1, 2, 3 and 12), and a second receptacle face 163 opposing the first receptacle face 161 and illustrated in FIG. 14. As further illustrated, located on each of the first receptacle face 161 and second receptacle face 163 are a pair of three-pronged receptacles 159. The receptacles 159 each include a hot conductor, neutral conductor and ground conductor. As illustrated in several of the drawings, including FIGS. 12-15, each of the upper and lower walls 172, 174, respectively, formed centralized grooves 165 and 167, respectively. That is, the groove 165 is associated with the upper wall 172, while the groove 167 is associated with a lower wall 174. Positioned within the groove 167 associated with the lower wall 174 are a pair of locking latches, namely a first locking latch 169 (FIGS. 1, 2, 3, 14 and 15), and second locking latch 171 (FIGS. 4, 14 and 15). Each of the locking latches 169,171 is substantially identical in structure. Correspondingly, positioned within the groove 165 associated with the upper wall 172 are another pair of locking latches, namely another first locking latch 173, and a second locking latch 175. These locking latches are illustrated in FIGS. 1, 2, 3, 13 and 15. With reference primarily to FIGS. 4 and 13, each of the locking latches 169, 171, 173 and 175 include as an inclined portion 176 integral with or otherwise connected to an upper wall 172 or lower wall 174, within one of the grooves 165 or 167. Extending outwardly from each of the inclined portions 176 is an outer tab 177. Each of these locking latches is resilient in nature. For example, with respect to the first locking latch 169, and with the position shown in FIGS. 1 and 4, upwardly directed forces on the first locking latch 169 will cause the locking latch to deflect and bend upwardly relative to its connection to the lower wall 174. Further, however, the first locking latch 169, as with the other locking latches, is of a resiliency such that after the upwardly directed deflecting forces are removed, the first locking latch 169 will return to its conventional and normal position, as illustrated in FIGS. 1 and 4. Each of the locking latches may consist of a resilient plastic material, such as polycarbonate. Such material permits deflection in the presence of external forces, and also exhibits internal restoring forces when the deflecting forces are removed. Such locking latches are well known in the art. The use of the locking latches for releasably securing the outlet receptacle block 160 in an electrical interconnection with the junction block 102 will be described in subsequent paragraphs herein.

Figure 3:
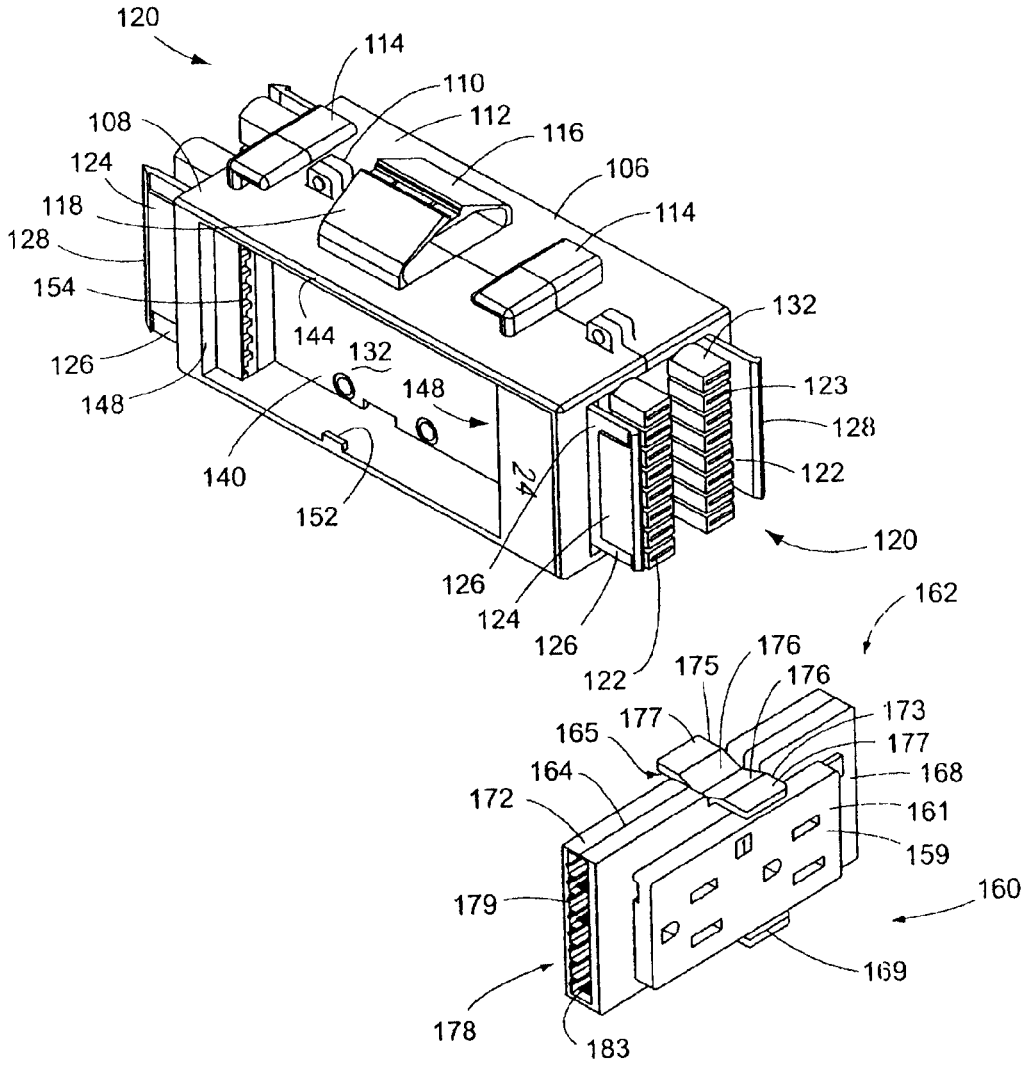
FIG. 3 is a further perspective and partially exploded view similar to FIG. 1, but illustrating the electrical outlet receptacle block in a reverse perspective view, so as to illustrate the particular connector set of the receptacle block which would be electrically interconnected to a connector set of the electrical junction block, assuming that the electrical outlet receptacle block is moved from the position illustrated in FIG. 1 into the electrical junction block through movement along arrow line A shown in FIG. 1.
Figure 4:
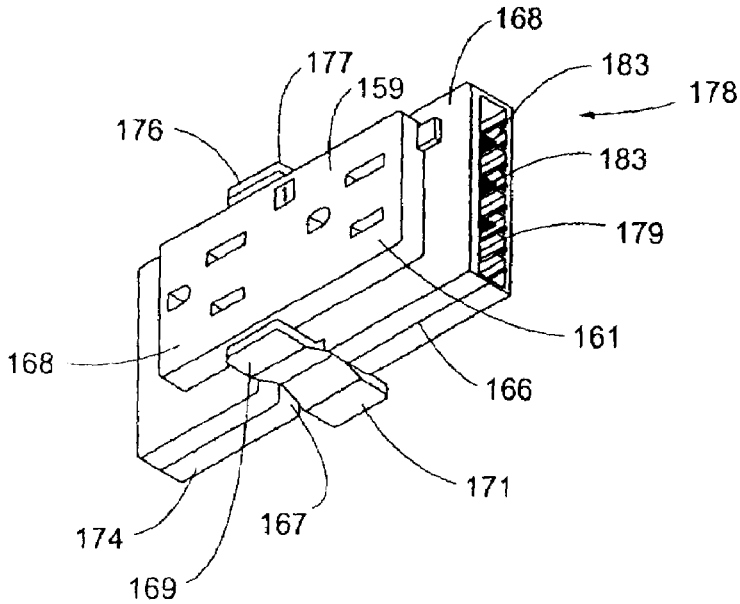
FIG. 4 is a perspective view of the electrical outlet receptacle block illustrated in FIGS. 1 and 2, with the view being a reversed perspective view so as to show the underside thereof.

The electrical outlet receptacle block 160 further includes a pair of male connector sets 178, with each of the male connector sets 178 extending outwardly from opposing ends of the receptacle block 160 as illustrated in several of the drawings, including FIGS. 1, 2 and 3. For purposes of description, the individual ones of the pair of male connector sets 178 are designated as the first male connector set 179 (illustrated in FIGS. 1 and 2), and second male connector set 181 (illustrated in FIG. 3). Each of the male connector sets 179, 181 include a particular configuration of male or bus bar terminals 183. For reasons apparent after subsequent description herein, the male terminals 183 exist only within certain of the connectors of the first and second male connector sets 179, 181.

Figure 7:
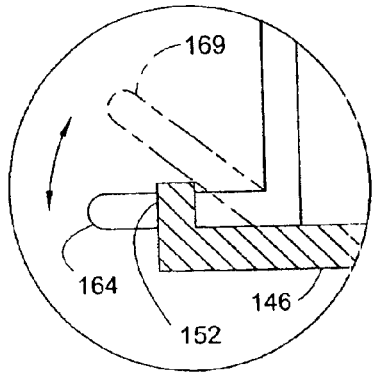
FIG. 7 is an enlarged view of a portion of the electrical junction block illustrated in FIG. 6, taken within circle 7 and illustrating the relative positioning of the electrical outlet receptacle block and the electrical junction block when the outlet receptacle block is electrically engaged with the junction block in a circuit 1 orientation.
Figure 8:
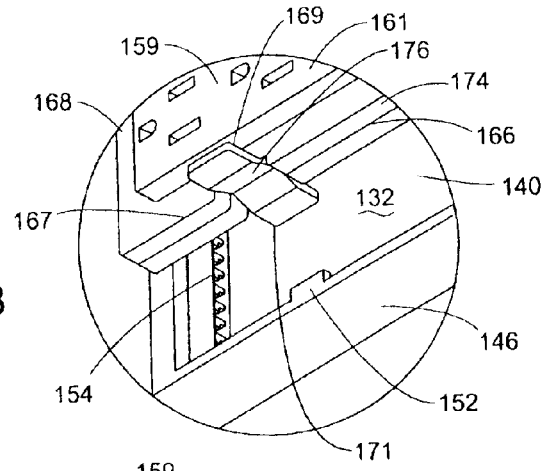
FIG. 8 is a partial perspective view of an electrical outlet receptacle block as illustrated in FIG. 4, illustrating the particular locking latch which is in an underside position, and further showing its position relative to the locking tab of the electrical junction block as the outlet receptacle block is being moved into an electrically engaging position with the junction block in a circuit 1 orientation.
Figure 9:
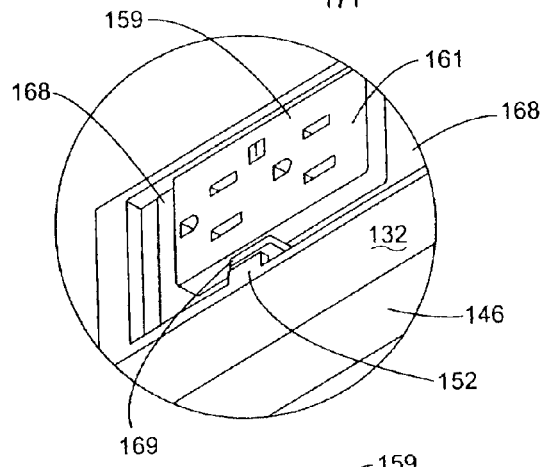
FIG. 9 is a partial perspective view similar to FIG. 8, and illustrating the locking latch of the outlet receptacle block being pushed upwardly by the locking tab of the junction block as the receptacle block is moved into the electrically engaging position.

The releasable and electrical interconnection of the outlet receptacle block 160 to the junction block 102 will now be described primarily with respect to FIGS. 1 and 6-10. As earlier mentioned, and as described in greater detail in subsequent paragraphs herein, the electrical outlet receptacle block 160 is capable of being electrically interconnected to the junction block 102 in any one of four physical orientations, so as to provide the capability of the receptacles of the outlet receptacle block 160 being electrically interconnected to any one of four incoming circuits. For purposes of description of these concepts and the procedure for interconnecting the outlet receptacle block 160 to the junction block 102, the particular configuration of the outlet receptacle block 160 as illustrated in FIG. 1 (and FIG. 16) is referred to herein as the "circuit 1 orientation." With reference to FIG. 1, and for purposes of interconnecting the outlet receptacle block 160 to the junction block 102 in the circuit 1 configuration, the outlet receptacle block 160 can first be positioned as illustrated in FIG. 1, relative to the junction block 102. For purposes of interconnection, the receptacle block 160 will be moved in a direction illustrated by arrow line A shown in FIG. 1. More specifically, and with reference to a "starting" position as illustrated in FIG. 8, the receptacle block 160 can be aligned with the junction block 102 so that the first and second locking latches 169, 171, respectively are in alignment and positioned slightly above the locking tab 152 of junction block 102.

As the receptacle block 160 is moved into the spatial area 140, the position of the locking tab 152 relative to the first locking latch 169 will cause the inclined portion 176 and outer tab 177 of the first locking latch 169 to deflect upwardly as the receptacle block 160 is moved into the spatial area 140. The spatial area 140 is of a sufficient depth and other dimensions so that the receptacle block 160 can be fully inserted into the spatial area 140. After insertion of the receptacle block 160 into the junction block 102, with the first locking latch 169 deflected upwardly by the tab 152, the receptacle block 160 can be moved to the "left" as illustrated by the arrow line A in FIG. 1. As the receptacle block 160 is moved to the left within the spatial area 140, two processes occur simultaneously. Specifically, the first male connector set 179 (FIG. 3) moves into an electrical engagement with the female connector set 154 located on one of the end walls 148 of the junction block 102. As earlier mentioned, the first male connector set 179 will have male terminals 183 only within certain of the connectors of the connector set 179. Accordingly electrical connections will be made between the male terminals 183 and only certain of the female connector terminals 156 of the connector set 154.

Figure 10:
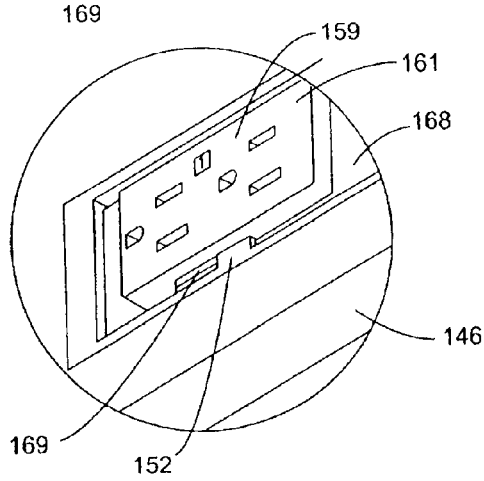
FIG. 10 is a partial perspective view similar to FIGS. 8 and 9, and illustrating the relationship of the locking latch of the outlet receptacle block relative to the locking tab of the junction block when the receptacle block is fully and electrically engaged with the junction block.

At the same time that electrical interconnection is being made between the receptacle block 160 and the junction block 102, and as the receptacle block 160 is being moved to the left within the spatial area 140 of the junction block 102, movement to the left by a sufficient distance will cause the first locking latch 169 to be moved past the locking tab 152. When the first locking latch 169 is fully moved to the left of the locking tab 152, the upwardly directed external forces exerted by the locking tab 152 are no longer applied to the first locking latch 169, and the first locking latch 169 moves downwardly to its "normal" position, i.e. its configuration in the absence of any externally applied forces (FIG. 10). This configuration of the first locking latch 169 and the locking tab 152 is illustrated by the solid line configuration of the outer tab 177 of the first locking latch 169 as illustrated in FIG. 7, and as also illustrated in the partial view of FIG. 10. With the first locking latch 169 in the position shown in solid line format in FIG. 7 and in FIG. 10, the receptacle block 160 cannot be removed from its electrical engagement with the junction block 102, in the absence of external forces exerted in a specific direction on the first locking latch 169. That is, any attempt to move the receptacle block 160 directly to the "right" within the spatial area 140 of junction block 102, so as to electrically disengage the receptacle block 160 from the junction block 102 is prohibited by the position of the locking tab 152 relative to the first locking latch 169. To actually disengage and electrically decouple the receptacle block 160 from the junction block 102, upwardly directed forces must be exerted on the first locking latch 169. These forces must be sufficient so as to deflect the first locking latch 169 upwardly a sufficient distance so that the outer tab 177 is essentially "above" the top of the locking tab 152. In this configuration, the first locking latch 169 is permitted to move to the "right" and above the locking tab 152. This "freedom" of movement correspondingly permits the male terminals 183 of the first male connector set 179 to be electrically disengaged from the female connector terminals 156 of the connector set 154 of junction block 102.

Figure 5:
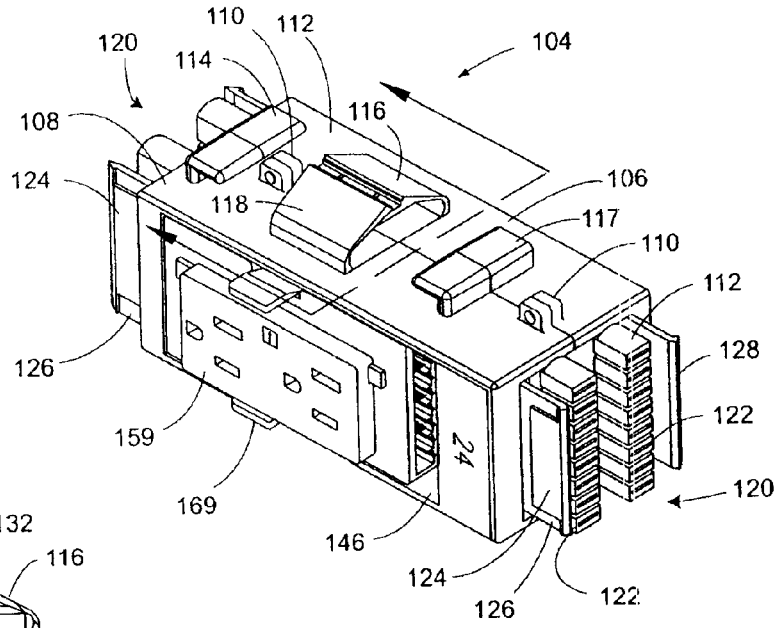
FIG. 5 is a perspective view of the electrical junction block and the outlet receptacle block of FIG. 1, with the outlet receptacle block in an electrically engaged position with the junction block, in a circuit 1 orientation.
Figure 6:
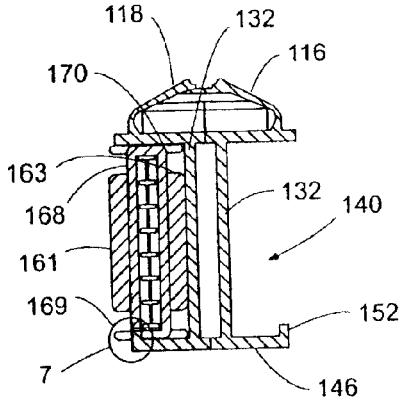
FIG. 6 is a sectional view of the electrical junction block and outlet receptacle block illustrated in FIG. 5, taken along section lines 6-6 of FIG. 5.

The foregoing has been a description of the process for electrical interconnection of the receptacle block 160 to the junction block 102 when the receptacle block 160 is to be in the circuit 1 orientation. As will be apparent from subsequent description, the other three circuit orientations of the receptacle block 160 which may be utilized in accordance with the invention will cause one of the second, third or fourth locking latches 171, 173 and 175, respectively, to be in the physical position and orientation of the first locking latch 169 for the circuit 1 orientation as illustrated in FIGS. 1 and 5.

The concepts of the invention specifically relating to the capability of providing for interconnection of a single outlet receptacle block to a selected one of a plurality of circuits will now be described, primarily with reference to FIGS. 16-27. Specifically, the multiple circuit receptacle system 100 can be characterized as an "8-wire" system, although the principles of the invention are not limited to only 8 wire system. In the 8 wire systems disclosed herein, the cable assembly 180 includes 8 wires (not specifically shown) inside the conduit section 182, each of which is electrically connected to a different one of the terminal blades (not shown) located in the male connector terminals 188 of the male connector set 186.

The 8-wire system comprises a series of hot, neutral and ground wires terminating on terminal blades in the connectors 188. For purposes of description, the terminals 188 themselves will be referred to as comprising hot, neutral and ground terminals. These terminals 188 are further referenced, for purposes of description, by individual reference numerals 200, 202, 204, 206, 208, 210, 212 and 214, as shown in FIG. 11. Further, the 8-wire system presented at the terminals 188 can provide four separate circuits, with each circuit consisting of three wires or terminals comprising hot, ground and neutral wires or terminals.

To electrically interconnect the receptacle block 160 to the junction block 102 for any one of the four circuits, one of either the first male connector set 179 or the second male connector set 181 of the outlet receptacle block 160 will be electrically connected to a female connector set 154 as previously described herein. However, for each of the four power supply circuits to be selectively applied to the receptacles 159, the receptacle block 160 will be in one of four different physical orientations, relative to the junction block 102. For purposes of description, the four available circuits will be identified as circuit 1, circuit 2, circuit 3, and circuit 4. The orientations of the outlet receptacle block relative to the junction block 102 for each of these circuits is designated herein as the circuit 1, circuit 2, circuit 3 and circuit 4 orientations, respectively.

To more specifically describe the foregoing concepts, the multiple circuit receptacle system 100 is described as having certain wires and terminals at the male connector set 186 associated with certain functional wires of a particular circuit. The relationship between these wires and terminals for these circuits can be defined as follows:

| Wire or Terminal | Function |
|---|---|
| 200 | H-4 |
| 202 | N-1 |
| 204 | H-3 |
| 206 | G |
| 208 | IG |
| 210 | H-2 |
| 212 | N-2 |
| 214 | H-1 |

where "H-n" represents the hot wire or terminal of the nth circuit (i.e. circuit n), "N-1" represents the first neutral wire or terminal, "N-2" represents the second neutral wire or terminal, "G" represents a ground wire or terminal and "IG" represents an isolated ground or terminal.

With respect to the common and ground wires or terminals, the four circuits may be "set up" in various ways with respect to application to the receptacle block 160. As will be described in subsequent paragraphs herein, the particular circuits applied to the receptacles 159 of the receptacle block 160, and the particular hot, neutral and ground wires or terminals associated with each circuit will be dependent upon the relative positioning of male terminal blades 183 in the first and second male connector sets 179, 181, respectively. In the particular configurations and orientations of the receptacle block 160 chosen for the exemplary embodiment 100 of a multiple circuit receptacle system in accordance with the invention, each of the particular circuits have the following wires or terminals electrically coupled to terminal blades 158 of the male connector sets 179, 181:

| Circuit No. | Wire or Terminal | |
|---|---|---|
| 1 | H-1 | (214) |
| | N-1 | (202) |
| | G | (206) |
| 2 | H-2 | (210) |
| | N-1 | (202) |
| | G | (206) |
| 3 | H-3 | (204) |
| | N-2 | (212) |
| | IG | (208) |
| 4 | H-4 | (200) |
| | N-2 | (212) |
| | IG | (208) |

To more fully explain the invention, the individual connectors of the first and second male connector sets 179, 181, respectively, of the receptacle block 160 will be numbered, with the corresponding numbers of wires or terminals of the cable assembly 180. That is, for example, connector 200 of the connector set 181 as illustrated in FIG. 1 would be electrically coupled to wire or terminal 200 of the cable assembly 180, assuming that a bus bar terminal 183 existed in connector 200 of the connector set 181, the connector set 181 was electrically connected to female connector set 154 of the junction block 102, and the cable assembly 180 was connected to one of the female connector sets 122 of the junction block 102.

For further purposes of understanding, each of the corners of the outlet receptacle block 160 is consecutively numbered 1, 2, 3 or 4, as primarily shown in FIGS. 20-23. This numbering will be used to facilitate describing the various physical orientations of the receptacle block 160 when connected to the junction block 102. Still further, and again for purposes of fill description, the male terminal blades 183 of the first and second male connector sets 179, 181 of the receptacle block 160 are characterized herein as being integral with bus bars of the receptacle block 160, namely bus bars 216, 218 and 220. These bus bars are primarily illustrated in FIGS. 20-23. Further, each of the receptacles 159 is characterized as comprising a ground receptacle terminal 222, neutral receptacle terminal 224 and hot receptacle terminal 226. Each of the receptacles 159 is adapted to be electrically coupled to a grounded electrical plug, having a ground prong adapted to be coupled to the ground terminal 222, large blade adapted to be connected to the neutral receptacle 224, and small blade adapted to be inserted into hot receptacle 226. The ground terminals 222 are connected to the bus bar 218, while the neutral terminals 224 are connected to bus bar 216 and the hot terminals 226 are connected to the bus bar 220. The bus bar 218 can be characterized as the ground bus bar, while the bus bar 216 can be characterized as the neutral bus bar and the bus bar 220 can be characterized as the hot bus bar.

Figure 16:
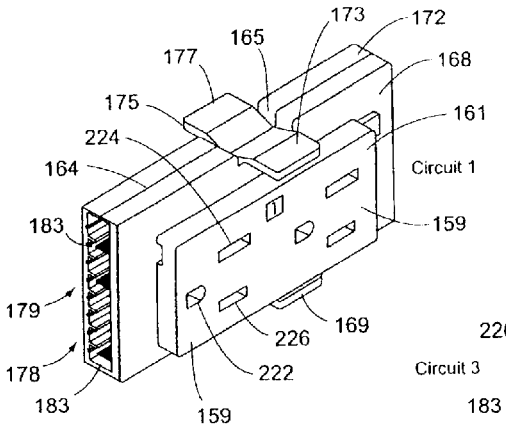
FIG. 16 is a perspective view of the electrical outlet receptacle block illustrated in FIG. 3, showing a circuit 1 orientation.
Figure 20:
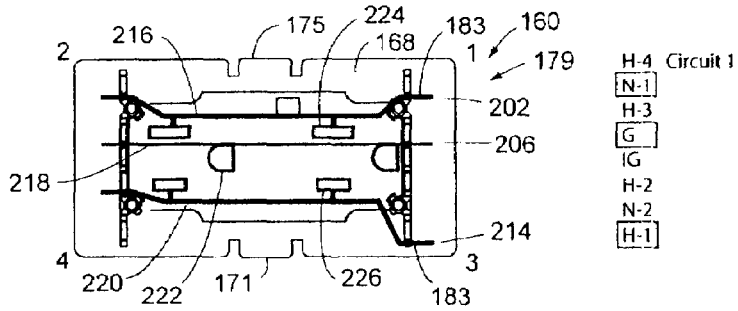
FIG. 20 is a sectional elevation view of the outlet receptacle block illustrated in FIG. 1, and showing the particular spatial configuration corresponding to FIG. 16 with a circuit 1 configuration (looking outwardly from the backside of first facial wall 168)

The various physical orientations of the receptacle block 160, and their associated circuit selections, will now be described. A circuit 1 configuration can be achieved by moving the receptacle block 160 through the path indicated by arrow line A in FIG. 1. This circuit 1 configuration is also illustrated in FIG. 16, which illustrates the second male connector set of the receptacle block 160. For a circuit 1 configuration, the receptacle block 160 is electrically coupled with the female connector set 154 being electrically connected to the second male connector set 181, and with the first locking latch 169 being located at the bottom of the receptacle block 160. For this circuit 1 configuration, the receptacle block is in a circuit 1 orientation, as also illustrated in FIG. 1. In this orientation, and as illustrated in FIG. 20, the blades 183 of the bus bars 216, 218 and 220 exist in terminal locations 202 (corresponding to N-1), 206 (corresponding to G) and 214 (corresponding to H-1), respectively. That is, circuit 1 is achieved with the physical orientation of the receptacle block 160 shown in FIGS. 1, 16 and 20. In this configuration, and with the particular view illustrated in FIG. 20, corner 1 is at the top right-hand corner of the receptacle block 160.

Figure 17:
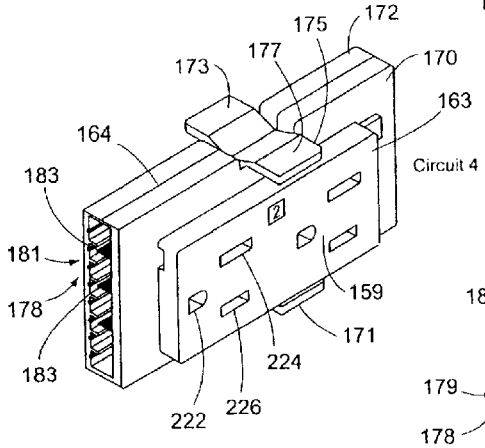
FIG. 17 is a perspective view similar to FIG. 16, but showing the outlet receptacle block "flipped" end to end so as to show a circuit 2 orientation.
Figure 19:
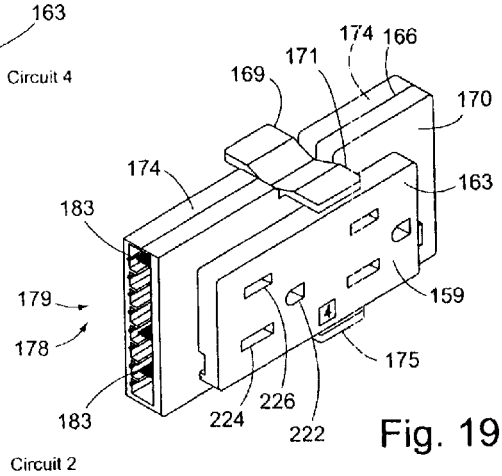
FIG. 19 is a perspective view of the outlet receptacle block shown in FIG. 18, with FIG. 19 illustrating a circuit 4 orientation provided by flipping the outlet receptacle block end to end relative to the configuration in FIG. 18.
Figure 21:
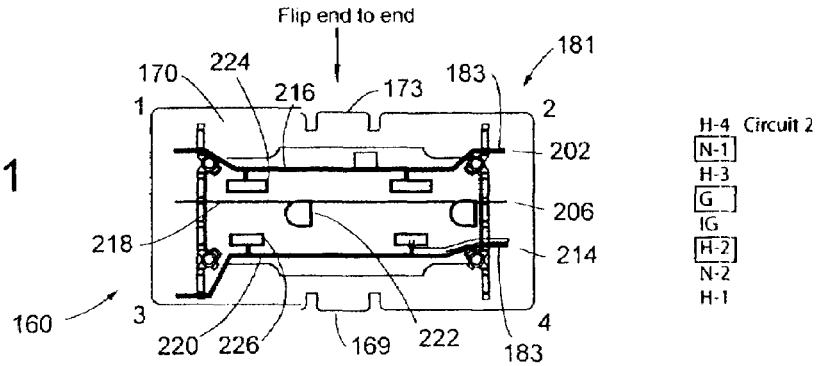
FIG. 21 is a sectional elevation view of the outlet receptacle block similar to FIG. 20, but showing the circuit 2 orientation corresponding to the configuration of the receptacle block illustrated in FIG. 17 (looking outwardly from the backside of second facial wall 170)

To achieve the circuit 2 configuration, the receptacle block 160 can be removed from the junction block 102 (in the manner previously described herein), and "flipped" end-to-end, so as to have the circuit 2 orientation as illustrated in FIG. 21. This circuit 2 orientation corresponds to providing the circuit 2 configuration for the receptacles 159. In this instance, the male terminal blades 183 to be electrically connected to corresponding connectors in the female connector set 154 correspond to wire or connector positions 202 (N-1), 206 (G) and 210 (H-2). Accordingly, the circuit 2 configuration consists of electrical connection between the receptacles 159 and cable assembly wires H-2, N-1 and G. This configuration is not only shown in FIG. 21, but is also illustrated in FIG. 17. In this configuration, it is the male connector set 181 which is electrically coupled to the female connector set 154 of the junction block 102.

Figure 18:
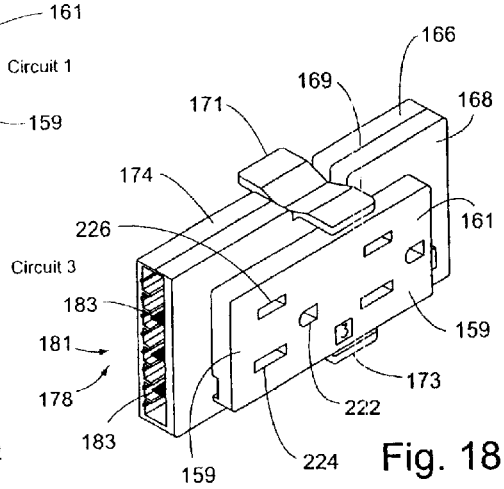
FIG. 18 is a perspective view of the outlet receptacle block shown in FIG. 17, with the receptacle block providing for a circuit 3 orientation by "flipping" the receptacle block from top to bottom relative to the configuration of the outlet receptacle block in FIG. 17.
Figure 22:
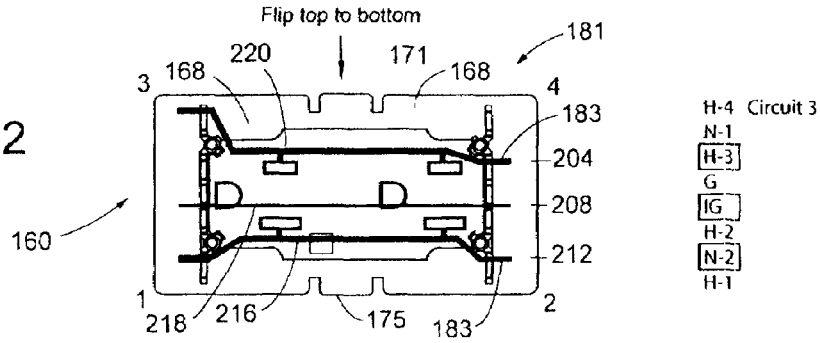
FIG. 22 is a sectional elevation view similar to FIG. 21, and further showing the circuit 3 orientation corresponding to the configuration of the receptacle block illustrated in FIG. 18 (looking outwardly from the backside of first facial wall 168)

Assuming that the receptacle block 160 has been in the circuit 2 orientation in the junction block 102, the receptacle block 160 can be removed from the junction block 102 and "flipped" from the top to the bottom so as to achieve a circuit 3 orientation as illustrated in FIGS. 18 and 22. In the circuit 3 orientation, the male terminal blades 183 which are interconnected to the female connector set 154 are in connector positions 204 (H-3), 208 (IG) and 212 (N-2). Accordingly, a circuit 3 configuration would consist of electrical interconnection of the receptacles 159 to the wires or connectors H-3, N-2, and IG. A circuit 3 configuration thus provides for an isolated ground. This configuration is illustrated in FIGS. 18 and 22. In this configuration, the male connector set 181 of the receptacle block 160 is electrically connected to the female connector set 154.

Figure 23:
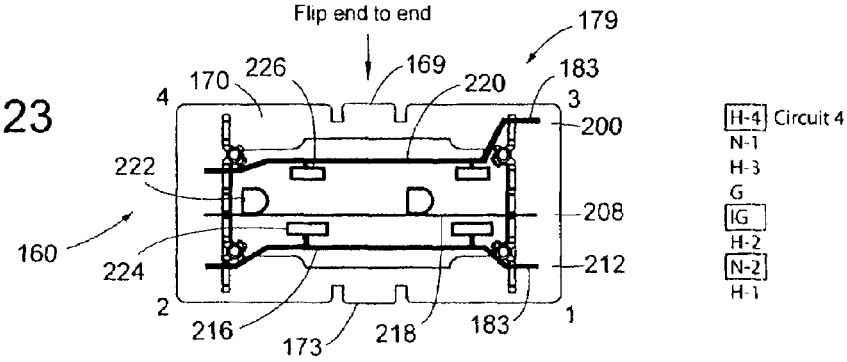
FIG. 23 is a sectional elevation view of the outlet receptacle block, similar to FIG. 22, but showing the receptacle block in a spatial configuration corresponding to a circuit 4 orientation, and further corresponding to the configuration of the outlet receptacle block as illustrated in FIG. 19 (looking outwardly from the backside of second facial wall 170)

With reference to FIGS. 18 and 22, the receptacle block 160 can be "flipped" end-to-end so as to provide for a circuit 4 orientation of the receptacle block 160. This circuit 4 orientation is primarily illustrated in FIGS. 19 and 23. With the receptacle block 160 in a circuit 4 orientation so as to provide for an electrical circuit 4 configuration, the male connector set 179 of the receptacle block 160 will be electrically connected to the female connector set 154 of the junction block 102. The electrical connection will be made as shown in FIG. 23, with the end of the hot bus bar 220 being located at the connector position 200 (corresponding to H-4), while the end of the ground bus bar 218 projects outwardly from the second male connector set 181 at connector location 208 (corresponding to IG). This location of the bus bar 218 will provide for an isolated ground. The neutral bus bar 216 has its end projecting outwardly through the male connector set 179 at connector position 212 (corresponding to N-2).

It should be noted that for purposes of understanding, FIG. 20 illustrates the first facial wall 168 from the backside of the same. That is, in viewing FIG. 20, the male terminal blades 183 of the bus bars 216, 218 and 220 project outwardly through the second male connector set 179 located to the right side of the receptacle 160 as viewed in FIG. 20. Correspondingly, FIG. 21, illustrating the circuit 2 orientation of the receptacle block 160, represents a view of the second facial wall 170 from the backside thereof. For the circuit 2 orientation as shown in FIG. 21, the blades 183 of the bus bars 216, 218 and 220 project outwardly through the male connector set 181 located on the right side of the view of the receptacle block 160 as shown in FIG. 21. For the circuit 3 orientation of the receptacle block 160, FIG. 22 illustrates the first facial wall 168 from the backside thereof. Blades 183 of the bus bars 216, 218 and 220 project outwardly into the male connector set 181 at the right side of FIG. 21. Still further, for the circuit 4 orientation illustrated in FIGS. 19 and 23, and specifically with respect to FIG. 23, the backside of the second facial wall 170 is shown in FIG. 23. The male terminal blades 183 of the bus bars 216, 218 and 220 project into the male connector set 179 located at the right side of the receptacle block 160, as viewed in FIG. 23.

To further insure an understanding of the various orientations of the receptacle block 160 for each of the four individual circuits, reference is again made to the individual receptacles 159 of the receptacle block 160. For a circuit 1 orientation of the receptacle block 160, as illustrated in FIGS. 16 and 20, the receptacles 159 on the first receptacle face 161 will be available to the user for acquiring power from the circuit 1 configuration. These same receptacles 159 presented at the first receptacle face 161 will also be available to the user for the circuit 3 configuration when the receptacle block 160 is in a circuit 3 orientation, as illustrated in FIGS. 17 and 21. Correspondingly, the receptacles 159 presented at the second receptacle face 163 will be available for to the user in the circuit 2 configuration and circuit 4 configuration, represented by the receptacle block being in the circuit 2 orientation and circuit 4 orientation as illustrated in FIGS. 17, 21 and 19, 23, respectively.

Figure 24:
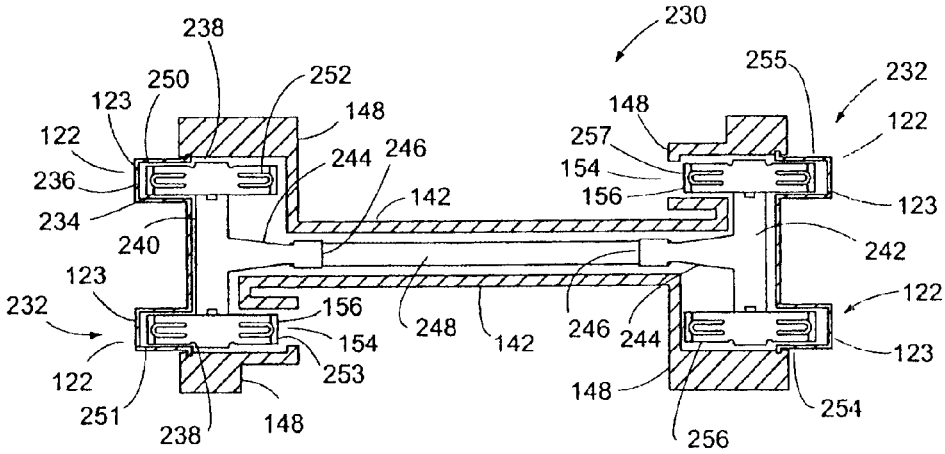
FIG. 24 is a plan view of one conductor assembly of the electrical junction block illustrated in FIG. 1, and further illustrating the conductor assembly as comprising a pair of H-block terminals having female connectors.

For a complete and full understanding of the electrical components utilized for providing the multiple circuit receptacle system 100 in accordance with the invention, reference is made to FIG. 24. Specifically, FIG. 24 illustrates a plan sectional view of junction block 102 (through section lines 24-24 of FIG. 1). This plan sectional view illustrates one connector assembly 230 which is utilized to bring incoming power through a female connector set 122 to one of the female conductor sets 154 and/or through the junction block 102 and outwardly through another of the female connector sets 122. Although only one connector assembly 230 is illustrated in FIG. 24, it should be understood that with the 8-wire system and the particular junction block 102 illustrated in FIG. 1, eight connector assemblies 230 will be assembled as part of the junction block 102. The eight connector assemblies 230 will be essentially "stacked" one on top of the other in a vertical disposition. The connector assemblies 230 can be secured within the junction block 102 and electrically isolated from one another in any conventional and well-known manner.

Turning specifically to the connector assembly 230 illustrated in FIG. 24, the connector assembly 230 is shown in its position relative to other elements of the junction block 102, such as the back walls 142 and end walls 148. The connector assembly 230 includes a pair of universal electrical contacts 232, positioned on opposing ends of the connector assembly 230. Each of the universal electrical contacts 232 includes four symmetrically arranged female receptacles, identified in FIG. 24 as receptacles 250-257, respectively. Receptacles 250-253 are located on the universal electrical contact 232 viewed on the left side of the drawing on FIG. 24, while female receptacles 254-257 are located on the universal electrical contact 232 shown as part of the universal electrical contact 232 on the right side of the drawing in FIG. 24. With reference back to the junction block 102 as illustrated in FIG. 1, the receptacles 250, 251, 254 and 255 each correspond to the terminals previously identified as female connector terminals 123. Correspondingly, the female receptacles 253 and 257 correspond to female connector terminals 156 previously identified as part of the female connector sets 154.

Turning to each of the individual female receptacles 250-257, each receptacle includes an upper cantilever member 234 and a lower cantilever member 236. The cantilever members 234, 236 are formed with arms 238. A bridge 240 extends between the arms 238 of the upper cantilever members 234. The upper and lower cantilever members 234, 236 are flexible and resilient in nature so as to be appropriately flexed when a male blade terminal (such as a male blade terminal projecting from the cable assembly 180 illustrated in FIG. 11) is inserted between the opposing cantilever members, thereby providing electrical contact.

Each of the universal electrical contacts 232 further includes a connecting beam 242 electrically connected by appropriate means to each of the four female receptacles of the contact 232. In turn, the connecting beam 242 is integral with or otherwise electrically connects to a transition portion 244. The transition portion 244, in turn, is connected to a channel 246. The channel 246 may, for example, be a channel which is formed by a pair of crimp wings or similar elements for providing appropriate electrical connections to other elements. In the particular embodiment illustrated in FIG. 24, each of the channels 246 is connected to an intermediate connecting wire or bus 248. The wire or bus 248 electrically interconnects the two universal electrical contacts 232. Additional detail regarding connector assemblies such as the connection assembly 230 and the universal electrical contacts 232 are disclosed in Byrne, U.S. Pat. No. 4,990,110 issued Feb. 5, 1991, and Byrne, U.S. Pat. No. 5,096,434, issued Mar. 17, 1992. The disclosures of these patents are hereby incorporated by reference herein.

One other advantageous aspect of the multiple circuit receptacle system 100 in accordance with the invention should be described. Specifically, in prior art systems, the outlet receptacle blocks are typically used in only one spatial orientation. This means that the one receptacle face (i.e. the surface where receptacles are made available to the user) and its associated ground, neutral and hot terminals are always in the same spatial orientation when electrically coupled to a particular junction block.

Figure 25:
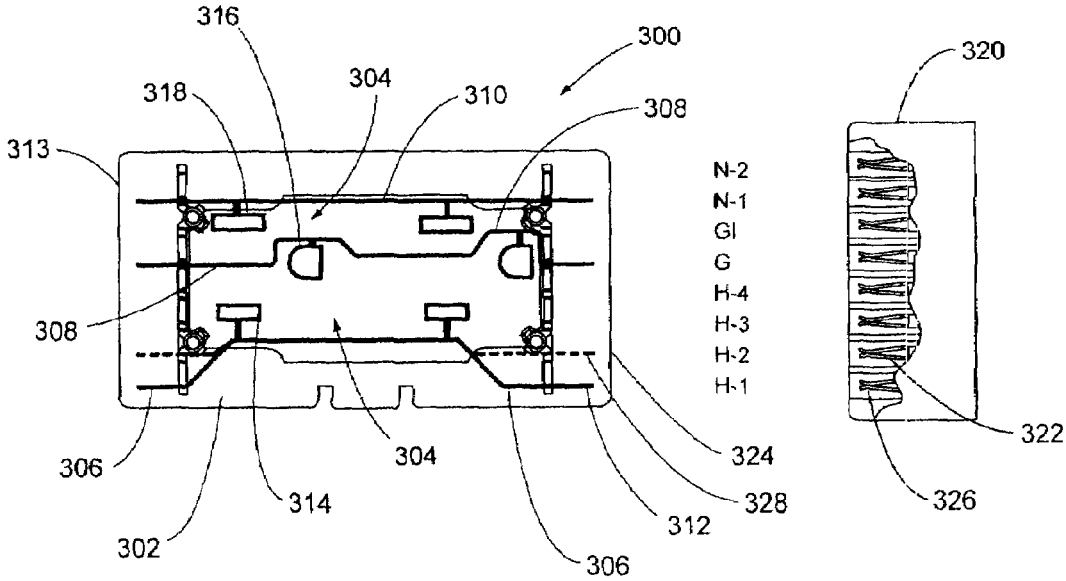
Fig. 25 (Prior Art)
FIG. 25 is a prior art sectional elevation view of a prior art outlet receptacle block, similar to the drawings of FIGS. 20-23, and illustrating the prior art configuration of the receptacle block when hot terminals associated with the incoming plurality of electrical circuits were spaced adjacent each other, without any intervening neutral or ground terminals.

This spatial orientation limitation is shown, in part, in the sectional elevation view of a prior art outlet receptacle block 300 illustrated in FIG. 25. FIG. 25 is a view similar to the views illustrated in FIGS. 20, 21, 22 and 23, in that FIG. 25 is a view looking outwardly from the backside of a facial wall 302 of the outlet receptacle block 300. The wall 302 which is being viewed is a wall on which a pair of receptacles 304 are located. The outlet receptacle block 300 includes a set of three bus bars, namely hot bus bar 306, ground bus bar 308 and neutral bus bar 310. Further, the prior art receptacle block 300 includes, within each receptacle 304, a hot receptacle terminal 314, ground receptacle terminal 316 and neutral receptacle terminal 318. The hot bus bar 306 is connected to the hot receptacle terminal 314, while the ground bus bar 308 is connected to each of the ground receptacle terminals 316. Correspondingly, the neutral bus bar 310 is connected to each of the neutral receptacle terminals 318.

As earlier stated, the prior art outlet receptacle block 300 is adapted to have only one spatial orientation relative to an electrically coupled junction block. Accordingly, the receptacle terminals 314, 316 and 318 always remain in a single spatial orientation.

As further illustrated in FIG. 25, each of the bus bars 306, 308 and 310 terminate at one end with a set of terminals extending into a first receptacle connector set 312. At the opposing ends of the bus bars 306, 308 and 310, terminals extend into a second connector set 313. For purposes of description, FIG. 25 also illustrates a female connector set 320, which could correspond to the female receptacle connector set 154 previously described herein and illustrated in FIGS. 1, 2, 3 and 11. The female connector set 320 includes a series of female connector terminals 322 as further illustrated in FIG. 25.

With the bus bars 306, 308 and 310 having the configuration illustrated in FIG. 25, blade terminals would be formed at opposing ends of each of the bus bars, so as to form the receptacle connector sets 312 and 313. In the particular orientation illustrated in FIG. 25, one blade terminal formed at the end of the hot bus bar 306 is aligned so that a blade terminal 324 formed at the end thereof would be received within the female terminal 326 of the set of female connector terminals 322. This would correspond to connecting the outlet receptacle block 300 to a "first" hot circuit. As further shown in FIG. 25, the bus bar 306 and its corresponding blade terminal 324 could be constructed so as to be positioned at other locations on the receptacle block 300. Each of these locations would correspond to the blade terminal 324 being received within one of the four hot female connector terminals shown as the four "lowest" connector terminals of the set of connector terminals 322 of connector set 320. For example, an alternative position for the bus bar 306 and male blade terminal 324 is illustrated in dotted line format in FIG. 25, and is shown as alternative position 328. In this alternative position, the blade terminal 328 would be received within the female connector terminal which would correspond to the second hot circuit identified as "H-2." Correspondingly, FIG. 25 illustrates blade terminals at the ends of neutral bus bar 308 as being positioned so that they would be aligned with the female connector of connector set 320 which corresponds to the ground or "G" conductor. FIG. 25 also illustrates the bus bar 310 as having its male blade terminals at the terminations thereof being aligned with a first neutral conductor, corresponding to position "N-1" as shown in FIG. 25.

In accordance with the prior art outlet receptacle 300, in order for the receptacle block 300 to be utilized with any one of the four separate circuits identified as H-1, H-2, H-3 or H-4, each of the hot terminals associated with the connector set 312 must be physically adjacent at least one of the hot female connectors of the connector set 320. Accordingly, to provide for the capability of readjusting the positions of the bus bars and terminating male blade terminals, without requiring "cross over" of the bus bars, all of the hot terminals 1'-1 through H-4 must be adjacent to one another. This adjacency of the hot terminals, without any ground or neutral terminal positioned intermediate the hot terminals, results in a greater probability of arcing between hot terminals and other potentially dangerous situations. As further illustrated in FIG. 25, for the hot terminals associated with the receptacle 300 to be spaced such that ground or neutral terminals are intermediate thereto, at least two of the three bus bars 306, 308 and 310 would necessarily have to "overlap" each other. Again, such overlapping or other adjacency of the bus bars 306, 308 and/or 310 would lead to potential arcing and other safety considerations.

In contrast, and as primarily illustrated in FIGS. 20, 21, 22 and 23, the configuration of the outlet receptacle block 160 is such that the incoming power supply circuits can be configured so that the hot wires and terminals associated with each of the four circuits are spaced apart from the hot wire or terminal of another one of the power supply circuits, and a neutral or ground wire or terminal is spaced intermediate any two of the hot wires or terminals. Still further, this configuration is achieved without the necessity of any of the bus bars illustrated in FIG. 20, 21, 22 or 23 to be overlapped or otherwise adjacent. This provides a significant advantage for the receptacle blocks in accordance with the invention.

In accordance with the foregoing, a multiple circuit receptacle system 100 has been disclosed and illustrated, and represents an exemplary embodiment of the invention. More specifically, the receptacle system 100 illustrates the use of a receptacle block (receptacle block 160) having not only connector sets on opposing ends of the receptacle block, but also illustrates a single receptacle block having electrical receptacles (receptacles 159) mounted on receptacle faces (namely, the first receptacle face 161 and the second receptacle face 163) projecting outwardly from opposing sides of the single receptacle block 160. Still further, the foregoing description of the receptacle system 100 illustrates the concept of a single receptacle block providing for the presentation, at outlet receptacles of the block, of a selected one of a plurality of power supply circuits. The selected one of the plurality of power supply circuits is achieved by maneuvering the receptacle block into various spacial orientations, relative to the junction block through which incoming power is supplied. This capability of selecting one of a plurality of power supply circuits does not require the use of multiple receptacles, or the use of any tools for electrically connecting and disconnecting the receptacle block from the junction block. Still further, the selective multiple circuits are achieved without requiring multiple junction blocks or any changes in structure or physical orientation of junction blocks. Still further, the multiple circuits are achieved without requiring any elements additional to the receptacle block and the junction block, such as circuit adapters or the like. Instead, circuit selection circumflexion is achieved by manually reconfiguring the physical orientation of the outlet receptacle block, relative to its interconnection to the junction block.

It will be apparent to those skilled in the pertinent arts that other embodiments of multiple circuit receptacle systems in accordance with the invention can be designed. That is, the principles of multiple circuit receptacle systems in accordance with the invention are not limited to the specific embodiment described herein. For example, an 8-wire system is described, with the capability of selecting any one of four power supply circuits. However, the principles of multiple circuit receptacle systems in accordance with the invention may be utilized with systems having a different number of wires or wire configurations, and for selection of a different number of power supply circuits. Still further, design concepts associated with the junction blocks themselves can be modified. In addition, receptacles utilizing hot, neutral and ground connections have been described in the example embodiment. Other types of receptacles may be utilized in accordance with the invention. Accordingly, it will be apparent to those skilled in the art that modifications and other variations of the above-described illustrative embodiment of the invention may be effected without departing from the spirit and scope of the novel concepts of the invention.

What is claimed is:

1. A multiple circuit receptacle system, said system comprising:

said power supply means for supplying electrical power to said multiple circuit receptacle system, said power supply means supplying said electrical power in the form of a plurality of power supply circuits; and an outlet receptacle block having receptacle means adapted to be electrically connected to selectively interconnected electrical devices, said outlet receptacle block further having receptacle circuit means for electrically and selectively coupling said receptacle means to said power supply means in a plurality of spacial orientations, with each of said spacial orientations causing a different one of said plurality of said power supply circuits to be electrically coupled to said receptacle means.

2. A multiple circuit receptacle systems in accordance with claim 1, characterized in that said receptacle circuit means comprises a plurality of electrical receptacle connector sets, each of said receptacle connector sets adapted to be electrically and selectively coupled to said power supply means.

3. A multiple circuit receptacle system in accordance with claim 2, characterized in that a particular one of said power supply circuits to which said receptacle means is coupled at any given time is dependent, in part, on which of said receptacle connector sets is electrically coupled to said power supply means.

4. A multiple circuit receptacle system in accordance with claim 2, characterized in that:

said plurality of receptacle connector sets comprises a first receptacle connector set and a second receptacle connector set;

said first receptacle connector set being capable of being electrically coupled to said power supply means in a first spacial orientation, thereby electrically coupling a first one of said power supply circuits to said receptacle means;

said first receptacle connector set further being capable of being electrically coupled to said power supply means in a second spacial orientation, thereby electrically coupling a second one of said power supply circuits to said receptacle means;

said second receptacle connector set being capable of being electrically coupled to said power supply means in a third spacial orientation, thereby electrically coupling a third one of said power supply circuits to said receptacle means; and said second receptacle connector set further being capable of being electrically coupled to said power supply means in a fourth spacial orientation, thereby electrically coupling a fourth one of said power supply circuits to said receptacle means.

5. A multiple circuit receptacle system in accordance with claim 1, characterized in that:

said receptacle circuit means comprises at least one receptacle connector set;

electrically coupling said at least one receptacle connector set to said power supply means in a first spacial orientation relative to said power supply means results in a first one of said plurality of power supply circuits being electrically coupled to said receptacle means; and electrically coupling said at least one receptacle connector set to said power supply means in a second spacial orientation relative to said power supply means results in a second one of said plurality of power supply circuits being electrically coupled to said receptacle means.

6. A multiple circuit receptacle system in accordance with claim 1, characterized in that:

said outlet receptacle block comprises a first side and a second side, said second side facing in an opposing direction to said first side; and said receptacle means comprises at least a first outlet receptacle on said first side of said outlet receptacle block, and at least a second outlet receptacle on said second side of said outlet receptacle block.

7. A multiple circuit receptacle system in accordance with claim 2, characterized in that said circuit means comprises:

a first receptacle connector set extending outwardly on a first end of said outlet receptacle block; and a second receptacle connector set extending outwardly on a second end of said outlet receptacle block.

8. A multiple circuit receptacle system in accordance with claim 1, characterized in that said power supply means comprises junction block means, said junction block means comprising:

incoming power supply connector means for receiving incoming electrical power; and outgoing junction block connector means electrically coupled to said incoming power supply connector means, and connectible to said receptacle circuit means for supplying said incoming power to said receptacle means.

9. A multiple circuit receptacle system in accordance with claim 8, characterized in that:

said receptacle circuit means comprises a first receptacle connector set and a second receptacle connector set;

said outgoing junction block connector means comprises a first outgoing junction block connector set;

connecting said first receptacle connector set to said outgoing junction block connector set, with said outlet receptacle block set being in a first spacial orientation relative to said first outgoing junction block connector set, results in said receptacle means being electrically coupled to a first one of said plurality of power supply circuits;

connecting said first receptacle connector set to said first outgoing junction block connector set, with said outlet receptacle block being in a second spacial orientation relative to said outgoing junction block connect set, results in said receptacle means being electrically coupled to a second one of said power supply circuits;

connecting said second receptacle connector set to said first outgoing junction block connector set, with said outlet receptacle block being in a third spacial orientation relative to said first outgoing junction block connector set, results in said receptacle means being electrically coupled to a third one of said plurality of said power supply circuits; and connecting said second receptacle connector set to said first outgoing junction block connector set, with said outlet receptacle block being in a fourth spacial orientation relative to said first outgoing junction block connector set results in said receptacle means being electrically coupled to a fourth one of said plurality if said power supply circuits.

10. A multiple circuit receptacle system in accordance with claim 8, characterized in that:

said outgoing junction block connector means comprises a first outgoing junction block connector set located on a first side of said junction block, and a second outgoing junction block connector set located on a second side of said junction block, said second side opposing said first side; and said receptacle circuit means is configured so as to be capable of electrically coupling to either of said first outgoing junction block connector set or said second outgoing junction block connector set.

11. A multiple circuit receptacle system in accordance with claim 1, characterized in that:

said receptacle circuit means comprises a first receptacle connector set associated with a first end of said outlet receptacle block, and a second receptacle connector set associated with a second end of said outlet receptacle block, said second receptacle end being opposed to said first receptacle end;

said first receptacle connector set having a plurality of terminals positioned so as to form a first configuration;

said second receptacle connector set having a plurality of terminals positioned so as to form a second configuration;

said outlet receptacle block having a top portion and a bottom portion, said bottom portion opposing said top portion;

said power supply means having a junction block with a first junction block connector set electrically coupled to said plurality of power supply circuits;

connection of said plurality of terminals of said first receptacle connector set to said first junction block connector set, with said outlet receptacle block being in a first spacial orientation, results in said receptacle means being electrically coupled to a first one of said plurality of said power supply circuits;

connection of said plurality of terminals of said second receptacle connector set to said first junction block connector set, with said outlet receptacle block being in a second spacial orientation relative to said junction block, results in said receptacle means being electrically coupled to a second one of said power supply circuits, when, in moving said outlet receptacle block from said first spacial orientation to said second spacial orientation, said outlet receptacle block is flipped end-to-end relative to said first junction block connector set;

connection of said plurality of terminals of said first receptacle connector set to said first junction block connector set, with said outlet receptacle block being in a third spacial orientation, relative to said junction block results in said receptacle means being electrically coupled to a third one of said plurality of power supply circuits, when, in moving said outlet receptacle block from said second spacial orientation to said third spacial orientation, said outlet receptacle block is flipped so as to reverse the positions of its top portion and its bottom portion, relative to said first junction block connector set; and connection of said plurality of terminals of said second receptacle connector set to said first junction block connector set with said outlet receptacle block being in a fourth spacial orientation relative to said junction block, results in said receptacle means being electrically coupled to a fourth one of said plurality of said power supply circuits, when, in moving said outlet receptacle block from said third spacial orientation to said fourth spacial orientation, said outlet receptacle block is flipped end-to-end relative to said first junction block connector set.

12. A multiple circuit receptacle system in accordance with claim 11, characterized in that:

said first junction block connector set is associated with a first side of said junction block, and said junction block further comprises a second junction block connector set electrically coupled to said plurality of power supply circuits, with said second junction block connector set being associated with a second side of said junction block, said second side of said junction block opposing said first side of said junction block;

connection of said plurality of terminals of said first receptacle connector set to said second junction block connector set, with said outlet receptacle block being in a fifth spacial orientation relative to said junction block, results in said outlet receptacle means being electrically coupled to said first one of said plurality of power supply circuits;

connection of said plurality of terminals of said second receptacle connector set to said second junction block connector set, with said outlet receptacle block being in a sixth spacial orientation relative to said junction block, results in said receptacle means being electrically coupled to said second one of said plurality of power supply circuits, when, in moving said outlet receptacle block from said fifth spacial orientation to said sixth spacial orientation, said outlet receptacle block is flipped end-to-end relative to said second junction block connector set;

connection of said plurality of terminals of said first receptacle connector set to said second junction block connector set, with said outlet receptacle block being in a seventh spacial orientation relative to said junction block, results in said receptacle means being electrically coupled to said third one of said plurality of said power supply circuits, when, and moving said outlet receptacle block from said sixth to said seventh spacial orientation, said outlet receptacle block is flipped so as to reverse the positions of its top portion and bottom portion, relative to said second junction block connector set; and connection of said plurality of terminals of said second receptacle connector set to said second junction block connector set, with said outlet receptacle block being in an eighth spacial orientation relative to the junction block, results in said receptacle means being electrically coupled to said fourth one of said plurality of said power supply circuits, when, in moving said outlet receptacle block from said seventh spacial orientation to said eighth spacial orientation, said outlet receptacle block is flipped end-to-end relative to said second junction block connector set.

13. A multiple circuit receptacle system in accordance with claim 1, characterized in that:

said outlet receptacle block comprises latch means;

said power supply means comprises at least one junction block having tab means; and said latch means and said tab means cooperate so as to prevent said receptacle circuit means from inadvertently releasing from said junction block in the absence of any externally exerted forces on said outlet receptacle block, when said receptacle means is electrically coupled to said junction block.

14. A multiple circuit receptacle system in accordance with claim 13, characterized in that:

said latch means comprises locking latches positioned on top and bottom portions of said outlet receptacle block, each of said locking latches being of a resilient construction;

said tab means comprises an upstanding tab, so that when said outlet receptacle block is first brought into position to be electrically coupled to said junction block, said tab exerts upwardly directed forces on at least one of said locking latches, thereby causing said at least one locking latch to resiliently deflect upward;

said tab and said at least one locking latch are sized and configured so that when said tab has caused said at least one locking latch to resiliently deflect upwardly, manual forces can be exerted sideways on said outlet receptacle block, so as to move said receptacle circuit means into electrical coupling with said power supply means; and when said power supply means is electrically coupled to said receptacle circuit means, said at least one locking latch is positioned to the side of said tab in a non-deflected state; and when said at least one locking latch is positioned to the side of said tab, said receptacle circuit means are prevented from becoming decoupled from said power supply means, in the absence of external forces being directed upwardly on said at least one locking latch, so as to resiliently deflect upwardly said at least one locking latch.

15. A multiple circuit receptacle system in accordance with claim 1, characterized in that said plurality of power supply circuits each comprise at least one hot conductor; and at least two of said hot conductors of two of said plurality of power supply circuits are physically separated by at least one of either a ground conductor or a neutral conductor.

16. A multiple circuit receptacle system in accordance with claim 1, characterized in that:

said power supply means supplies said electrical power in the form of an 8-wire supply, with said 8-wire supply comprising four hot conductors, two neutral conductors and two ground conductors; and each of said hot conductors is physically separated by at least one of either of said neutral conductors or said ground conductors.

17. A multiple circuit receptacle system in accordance with claim 1, characterized in that:

said outlet receptacle block comprises at least one outlet receptacle having hot, neutral and ground receptacle terminals, with said receptacle terminals being connected to hot, neutral and ground bus bars, respectively; and said outlet receptacle block provides for selectively and electrically coupling any one of at least three of said power supply circuits to said receptacle means, in the absence of any overlapping of any two of said bus bars, and with said power supply circuits having hot, neutral and ground terminals, and where any two of said hot terminals are separated by an intermediate one of said ground terminals or an intermediate one of said neutral terminals.

18. A multiple circuit receptacle system, said system comprising:

incoming power in the form of a plurality of power supply circuits;

at least one junction block having incoming connector means for electrically coupling said plurality of power supply circuits to said junction block;

said junction block comprising means for transmitting said incoming power to a first outgoing connector set;

an outlet receptacle block having a plurality of outlet receptacles adapted to be electrically connected to selectively interconnected electrical devices, said outlet receptacle block having a first receptacle connector set with a plurality of first terminals therein, said first terminals adapted to be electrically and selectively coupled to said first outgoing connector set in a plurality of spatial orientations, with each of said spatial orientations causing a different one of said plurality of said power supply circuits to be electrically coupled to said plurality of said outlet receptacles.

19. A multiple circuit receptacle system in accordance with claim 18, characterized in that said outlet receptacle block further comprises a second connector set having a second set of terminals therein, with said second set of terminals being adapted to electrically and selectively couple said outlet receptacle block to said first outgoing connector set in a plurality of spatial orientations, with each of said spatial orientations causing a different one of said plurality of said power supply circuits to be electrically coupled to said plurality of outlet receptacles.

20. A multiple circuit receptacle system in accordance with claim 19, characterized in that said junction block comprises a second outgoing connector set adapted to be selectively and electrically coupled to said first terminals and said second terminals of said outlet receptacle block, and where said second outgoing connector set is located on a side of said junction block opposing a side of said junction block on which said first outgoing connector set is located.

21. A multiple circuit receptacle system in accordance with claim 19, characterized in that said outlet receptacle block comprises a plurality of bus bars electrically connecting said first terminals and said second terminals to said outlet receptacles.

22. A system for supplying electrical power to a receptacle system, said system comprising:

a source of incoming electrical power;

a junction block electrically connected to said source of incoming electrical power;

an outlet receptacle block adapted to be selectively and electrically coupled to said source of incoming electrical power through said junction block; and said outlet receptacle block comprises a plurality of outlet receptacles, with at least one outlet receptacle located on each of two opposing sides of said outlet receptacle block.

* * * * *